US007743565B2

(12) United States Patent
Pyo

(10) Patent No.: US 7,743,565 B2
(45) Date of Patent: Jun. 29, 2010

(54) MODULAR BUILDING BLOCK SYSTEM AND METHOD OF MANUFACTURE

(76) Inventor: John M. Pyo, P.O. Box 3608, San Luis Obispo, CA (US) 93403

( * ) Notice: Subject to any disclaimer, the term of this patent is extended or adjusted under 35 U.S.C. 154(b) by 8 days.

(21) Appl. No.: 11/557,956

(22) Filed: Nov. 8, 2006

(65) Prior Publication Data

US 2008/0104906 A1 May 8, 2008

(51) Int. Cl.
*E04C 2/52* (2006.01)

(52) U.S. Cl. ..... 52/220.2; 52/220.1; 52/220.3

(58) Field of Classification Search ..... 52/220.2, 52/220.3, 79.7, 79.9, 220.1, 220.7, 287.1, 52/288.1
See application file for complete search history.

(56) References Cited

U.S. PATENT DOCUMENTS

| | | | | | |
|---|---|---|---|---|---|
| 950,140 | A * | 2/1910 | Lucke | 52/505 |
| 1,836,408 | A * | 12/1931 | Sutton | 52/220.2 |
| 1,981,324 | A * | 11/1934 | Peterson | 52/591.2 |
| 2,010,294 | A * | 8/1935 | Dovell | 52/241 |
| 4,154,030 | A * | 5/1979 | Huguet | 52/98 |
| 4,694,624 | A * | 9/1987 | Juhas | 52/223.7 |
| 4,854,097 | A * | 8/1989 | Haener | 52/309.11 |
| 4,884,382 | A * | 12/1989 | Horobin | 52/426 |
| 5,182,884 | A * | 2/1993 | Tarics | 52/79.14 |
| 5,881,511 | A * | 3/1999 | Keller, Jr. | 52/220.2 |
| 5,964,067 | A * | 10/1999 | Lehner et al. | 52/220.2 |
| 6,112,473 | A * | 9/2000 | Pingel | 52/79.1 |
| 6,962,028 | B2 * | 11/2005 | Banova | 52/592.5 |
| 2003/0167715 | A1 * | 9/2003 | Messenger et al. | 52/309.12 |

OTHER PUBLICATIONS

Int'l Searching Authority, , *International Search Report and Written Opinion of the International Searching Authority for PCTUS0783999* mailed Jul. 11, 2008.

Shaikh, Fattah A. , "PCI Design Handbook 5th Edition", Apr. 1999, 9-51-9-56.

* cited by examiner

*Primary Examiner*—Richard E Chilcot, Jr.
*Assistant Examiner*—Mark R Wendell
(74) *Attorney, Agent, or Firm*—Thomas F. Lebens; Sinsheimer Juhnke Lebens & McIvor, LLP

(57) ABSTRACT

A first load bearing component is adapted to provide load bearing strength when the modular building block is used in a building panel. A second load bearing component is coupled to the first load bearing component via a first coupling arrangement and is adapted to provide load bearing strength when the modular building block is used in the building panel. A building services component is positioned between the first load bearing component and the second load bearing component for providing a conduit for at least one building service. The first and second load bearing components and the building services component are adapted to be configurable in a plurality of positions relative to the other.

10 Claims, 22 Drawing Sheets

MODULAR BUILDING BLOCK SYSTEM AND METHOD OF MANUFACTURE

FIELD OF THE INVENTION

The field of the invention relates to building materials and, more specifically, to components used to construct building panels and other building structures.

BACKGROUND OF THE INVENTION

Home buyers of today demand products that are cost-effective, flexible in use, and visually pleasing. In addition, home buyers desire an immense variety of choice in the areas of architectural styles and floor plans. For instance, some buyers may desire homes with traditional floor plans and construction materials while others may prefer more contemporary styles and materials.

In the construction industry, the cost of materials, labor, and land are some factors that are typically taken into account when constructing a building or other structure. In order to reduce the cost of some or all of these factors and still meet the demands of buyers, various materials have been developed such as cement board siding, high efficiency energy saving windows, and engineered wood products. In other examples, prefabrication techniques have been used to construct homes in factories.

Unfortunately, the previous materials, products, and approaches described above have not necessarily decreased the cost of constructing buildings and still meet the design needs of customers. For instance, prefabrication approaches can only provide design versatility at the expense of high fabrication costs. In addition, the quality of the home constructed using such techniques is often inadequate due to the necessity of using low cost materials to reduce the overall home cost. As a result of these problems, previous approaches for home construction have proven inadequate to provide a cost-effective product while at the same time meeting the design requirements of consumers.

SUMMARY OF THE INVENTION

A modular building block is provided that facilitates the construction of cost-effective building structures while at the same time providing a wide variety of design choices for consumers. A method of manufacturing these blocks is also provided along with an automated ordering, manufacturing, and distribution process allowing a customer to place an order for a building block having a specific structure and allowing the building block to be automatically manufactured and delivered to an end user (e.g., a construction contractor).

The blocks can be used in a wide variety of structures such as the walls of buildings. The walls create provide shelter and protection for building occupants, contribute to structural strength of the building as a whole, and facilitate the integration of auxiliary systems (e.g., electrical or plumbing systems).

In addition to being used to form building walls, the blocks can be used in floor, roof, foundation, or other types of assemblies. The assemblies formed can be precut, preassembled, and easily shipped to job sites where the assemblies can be easily incorporated into buildings or other structures.

The materials, blocks, design processes, manufacturing processes, and distribution processes described herein can also be used in any type of building, storage vessel, bridge, retaining walls and levees, aerospace structure, or high rise structure. The structures and processes described herein also facilitate the fabrication of complex shapes such as domes, cylinders, spheres, and cones. Corners and intersections can also be prefabricated as well as trims for door and window openings or end of wall terminations. In another example, a component panel arrangement could provide air/space for conventional integration of plumbing components, electrical components, insulation components, or other types of components.

In many of these embodiments, a modular building block includes a first load bearing component that is adapted to provide load bearing strength when the modular building block is used in a building panel (e.g., a wall). A second load bearing component is coupled to the first load bearing component via a first coupling arrangement. The second load bearing component is also adapted to provide load bearing strength when the modular building block is used in the building panel. Additionally, a building services component is positioned between the first load bearing component and the second load bearing component for providing a conduit for at least one building service. The first and second load bearing components and the building services component are adapted to be configurable in a plurality of positions relative to each other.

Various coupling arrangements may be provided to couple the components of the building block together. For example, the coupling arrangements may utilize one or more coupling pins, braces, and/or brackets. Other types of coupling arrangements may also be used.

The building services component may assume many different configurations and provide a wide variety of functions. For instance, the building services component may be a seismic restraint component. In this case, the seismic restraint component may be coupled to the first and second load bearing components via a second coupling arrangement and may be adapted to provide structural flexibility for the modular building block. In another example, the building services component may provide for or house plumbing elements. In still another example, the building services component may provide for or house electrical components or connections. In another example, a vapor barrier panel may be used as a barrier to water, chemical, or other types of vapor.

The load bearing components may also take on a number of different forms or configurations. For example, the first and second load bearing components may be structured as a plurality of trusses or may be constructed of solid or semi-solid materials.

In others of these embodiments, a building panel includes a plurality of modular building blocks. Each of the modular building blocks includes a plurality of modular layers or components. The layers are adapted to be configurable in a plurality of different positions relative to the other layers, and at least one of the building blocks includes a conduit component. The blocks are coupled together via a coupling arrangement.

The coupling arrangement may include one or more coupling pins. Additionally, an opening may be included in the panel. For example, the opening may be a door or a window. Furthermore, some or all of the modular layers of the building blocks may be structured as a plurality of trusses.

The components of the blocks may be configured to provide a variety of functions. For instance, at least one of the building blocks may include a vapor barrier component. In another example, a conduit component may be used to provide plumbing functions. In still other examples, a conduit component may be used to provide electrical connections and functionality. In yet another example, an insulation component may be used.

In others of these embodiments, a method of manufacturing a modular building block component is provided. A mold is provided to form a modular building block component and the mold includes a plurality of channels that form the structure of the modular building block component. A reinforcement winding in inserted within the plurality of channels of the mold to provide strength for the modular building block component. The reinforcement winding may be cured (e.g., when the winding is fiber) and the side panels are placed around edges of the mold. A base material is injected into the channels of the mold to form the modular building block component and the mold and the side panels are detached from the formed modular building block component. The mold may be used to form a plurality of the modular building block components. Thereafter, each of the modular building block components may be separated from the others.

Various base materials can be used to construct the components. In one example, the base material inserted into the mold comprises cement. Other examples of base materials may also be used.

In still others of these embodiments, an automated ordering, manufacturing, and distribution process allowing a customer or customers to place an order for a specific building block structure and have the building block automatically manufactured and delivered to an end user (e.g., a construction contractor) is provided.

In one example, instructions are received from a customer and the instructions include specifications for one or more modular building blocks. The building blocks are constructed according to the instructions of the customer, stored in a storage area, and shipped to the customer. The building blocks may be labeled for ease of assembly. Thereafter, the blocks may be assembled into a building panel such as a wall structure.

Advantageously, the above described approaches have a high degree of design and structural flexibility and are customizable and not limited to specific architectural designs or floor plans. Material, labor, and construction costs are reduced. The present approaches also allow for structural openings (e.g., windows and doors) to be placed almost anywhere in the structure while maintaining structural integrity. The building blocks can be fabricated using automated processes and entire buildings can be prefabricated as building blocks, precut, marked, and palletized for shipping. The use of scarce resources (e.g., lumber) can also be reduced by using these approaches. Moreover, constructing a building is greatly simplified and the cost is reduced. Furthermore, various types of computer software or computer processes may facilitate the design, fabrication, delivery, and construction processes.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE PREFERRED EMBODIMENTS

Referring now to FIGS. 1*a-f*, one example of a building block 100 that includes various types of components, panels, or layers is described. In this example, the building block 100 includes load bearing components and building services components. The building services components may provide a variety of functions. For example, the building service components may provide seismic protection, vapor protection, electrical functions, and or/plumbing functions. The load bearing and building services components may be coupled together with any type of coupling arrangement such as connector pins. It will be appreciated that other examples of blocks with other types of internal components are possible and that the various components may be arranged or internally connected within the block in a variety of different ways. For example, although the components of FIGS. 1*a-f* are shown as positioned one next to the other in a layered fashion, these components may be positioned in other ways, angles, and positions (e.g., at right angles to the others to form a box-like structure).

Figure 1A:
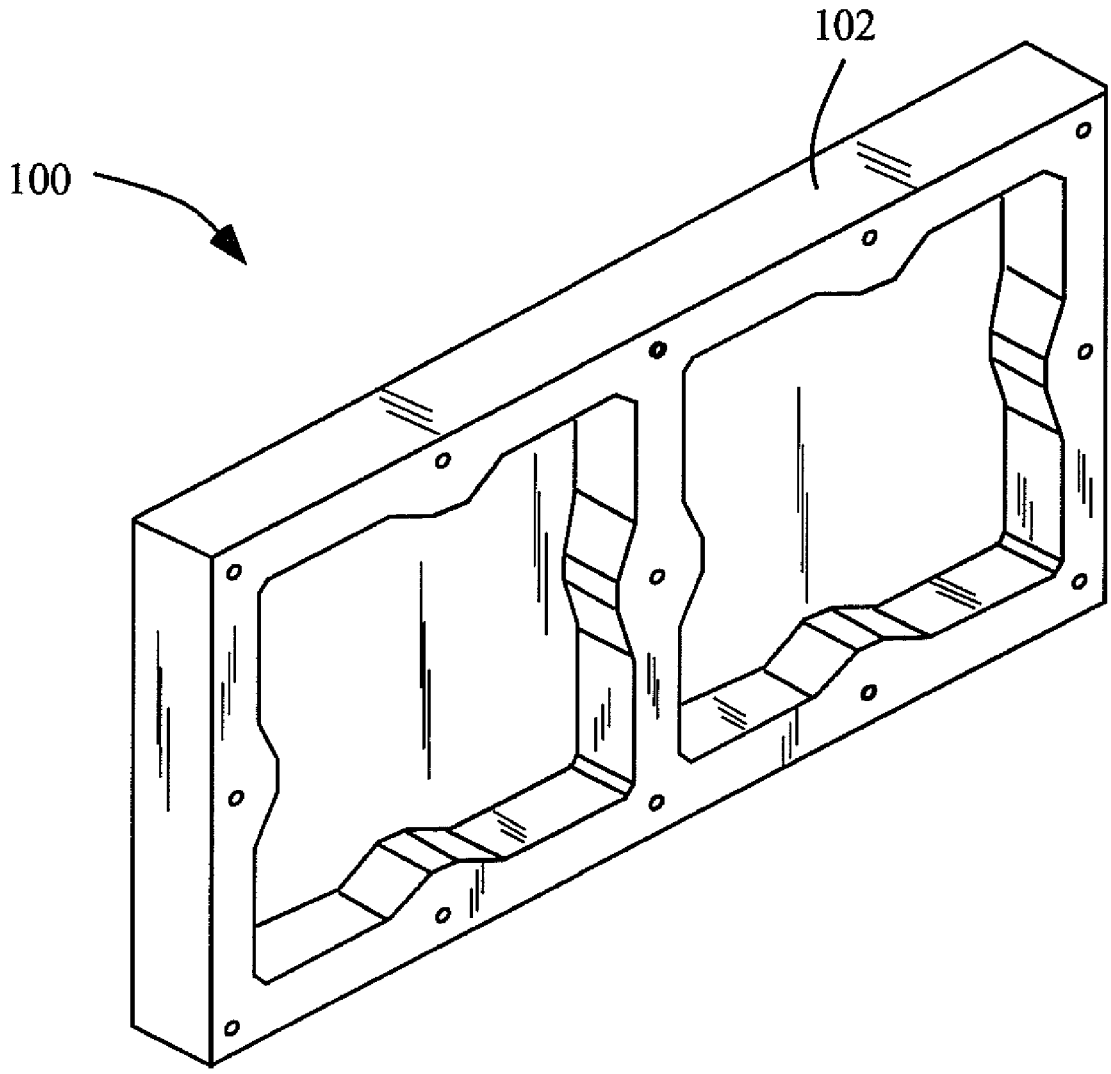
FIGS. 1*a-f* are perspective views of a block comprising various components according to the present invention.
Figure 1B:
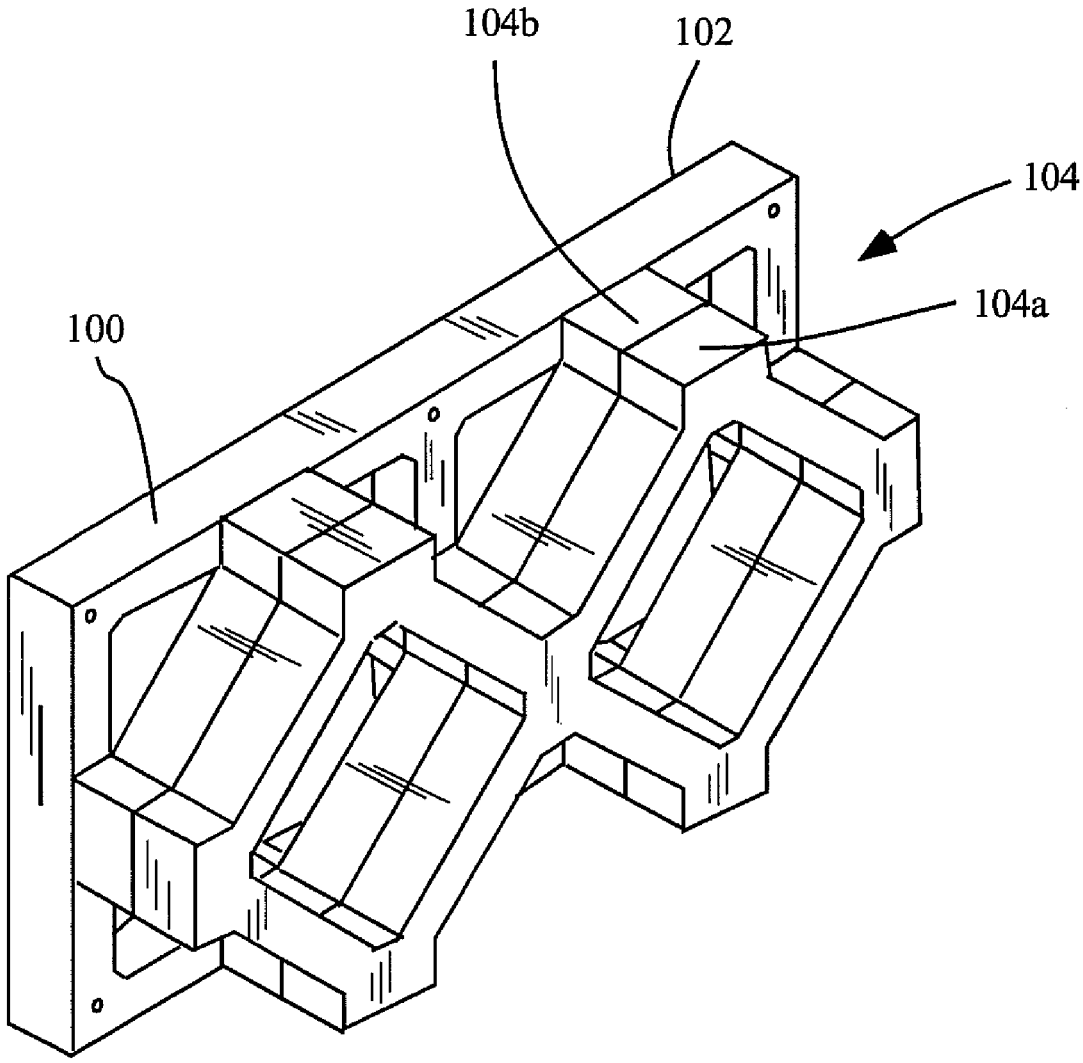

Referring now specifically to FIGS. 1*a-b*, one example of a portion of a building block 100 is described. An outer component 102 in the form of a flat panel is positioned at and forms one side of the building block 100. The outer component 102 may be constructed of any suitable material such as cement (e.g., Portland cement), woods, woven wire, plastics, metals, Calcium Aluminate Cement (CAC) or any combination of these or other materials. Polymers, reducers, and specialized aggregates can be used as ingredients of these materials. These materials provide for rigidity and compressive strength. In some cases, the outer component 102 may be used as formwork for poured-in-place concrete.

When cement is used, the components may be formed using the hot mold casting technique as described herein. Using this technique advantageously speeds the chemical reactions used in cement resulting in faster production using less space. It will be appreciated that the hot mold casting described herein may also be used for the production of other construction-related items such as roof tile (e.g., simulated wood shake), floor tile, architectural stone casting, pottery, or cultured stone veneers.

As mentioned, various types of aggregates may also be used to form the components of the block. In one example, a Wollastonite aggregate with a high aspect length to diameter (e.g., 15:1) is used. Ceramic microspheres may be used in any of the materials to provide weight reduction.

In one example, a batch of material may be formed for use in block components that includes seven pounds of Portland cement, three pounds of Calcium Aluminate Cement, 1 pound of Pozzolin (highly reactive metakaolin) and a microfiber aggregate (e.g., nyad g, Wollastonite). In addition, 0.1 pounds of fiber reinforcement (e.g., a polyvinyl acetate fiber) and glass spheres (e.g., 3m Scotchlite) may be used. The batch may be 0.43% water, use 0.2 pounds of a polymer admix (e.g., Vinnepas 5044n), be 0.2% retarder (e.g., citric acid), be 2.25% water reducer (e.g., Melflux 2651), be 1% accelerator (e.g., lithium carbonate), and include a Rheological stabilizer such as Melvis 200.

In another example, a calcium sulfo-aluminate cement may be used. This cement is specifically manufactured as a rapid setting, high early strength cement. Higher compressive strengths can be achieved with this type of cement, and may be less detrimental to the environment as a result of manufacturing methods.

With the use of polyvinyl acetate fibers (pva) a polymer additive is preferably not used. With other types of fibers such as glass, a polymer may be used used. Additionally, Portland cement can be replaced with either type-f or type-c fly ash (having a compositional range of 10 to 40% of total Portland cement). Further, a Pozzolan type reaction can be created, in addition to the typical reactions of the cement, with the introduction of various types of materials such as silica fume, reactive metakaolin, or micron 3.

In another example of a mix, 160 pounds of material (mix) may be created. In this example, the mix includes 60 pounds of Portland cement; 20 pounds of calcium aluminate cement; 20 pounds of fly ash; 10 pounds of reactive metakaolin; 15 pounds of calcium silicate (e.g., Nyad G Wollastonite used as a microfiber aggregate); 35-42 pounds of water (e.g., 0.35-0.42 water/cement). In this approach, the mix is 1-1.5% high range water reducer (e.g., Melflux 2651) by weight of cementatious material; 0.05-1% accelerator (e.g., lithium carbonate) by weight of cementatious material; and 0.05-5% Rheological stabilizer (e.g., Melvis 200) by weight of cementations material.

A reinforcing component 104 is placed parallel to and then coupled to the outer component 102. Additionally, the reinforcing component 104, in one example, may provide seismic relief functions. The coupling between the various components of the block may utilize pins, screws, nails, adhesive, or any suitable approach and/or material.

The reinforcing component 104 may include a first reinforcing sub-component 104*a* and a second reinforcing sub-component 104*b*. The reinforcing component 104 may be constructed using any number of patterns or structures but in one approach is constructed using a truss-like structure as described elsewhere in this specification. In one example, the trusses of the reinforcing component 104 may be formed from concrete that are reinforced with metal rods, wires, roping, or fibers. The type and diameter of the reinforcement component (e.g., fiber) used for the reinforcement along with the quality and layout of the reinforcement component provides the desired strength characteristics for the reinforcing component 104. Sheet metal panels can be used as an alternate structural bracing panel or in addition to the seismic component.

Figure 1C:
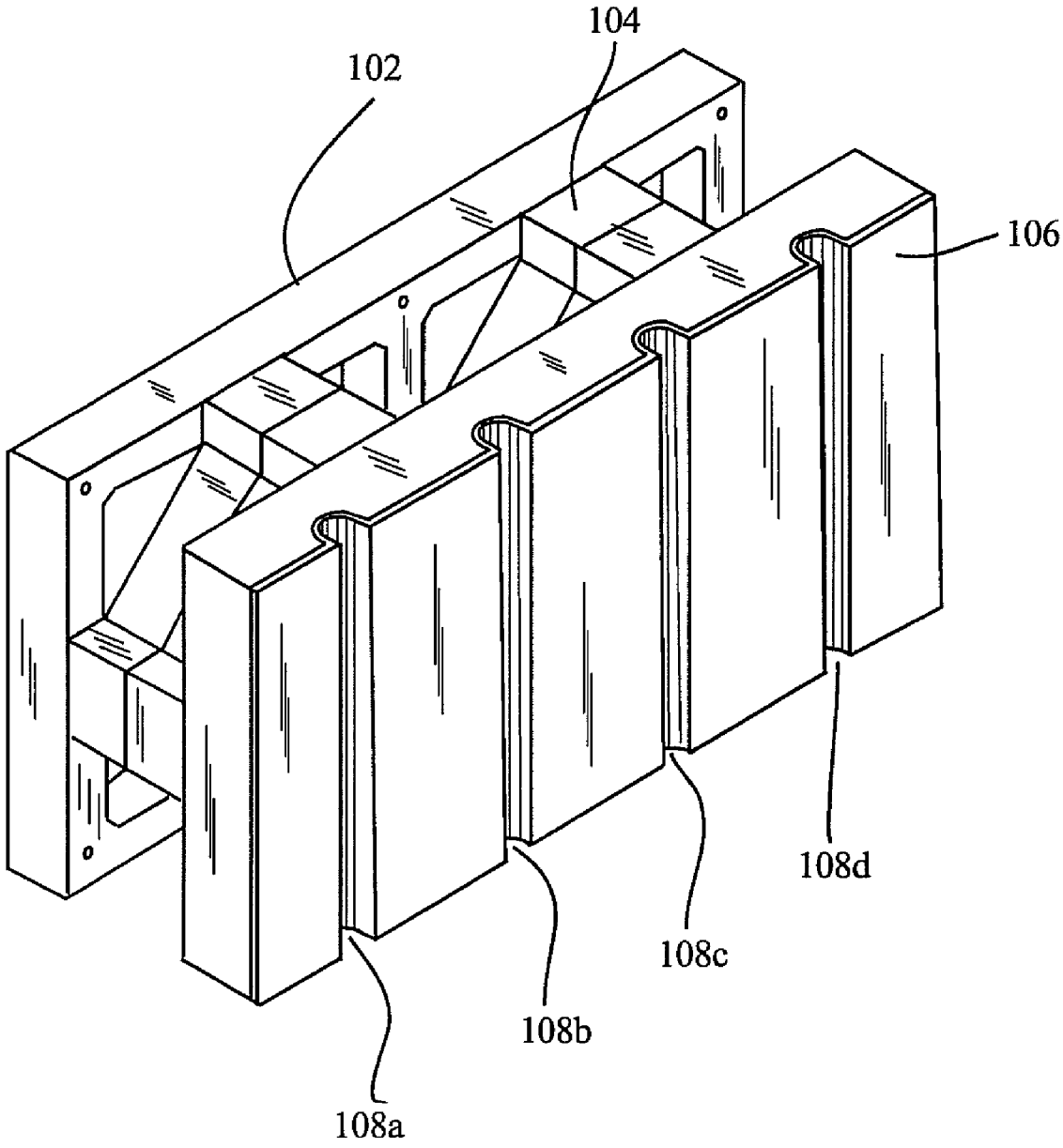
Figure 1D:
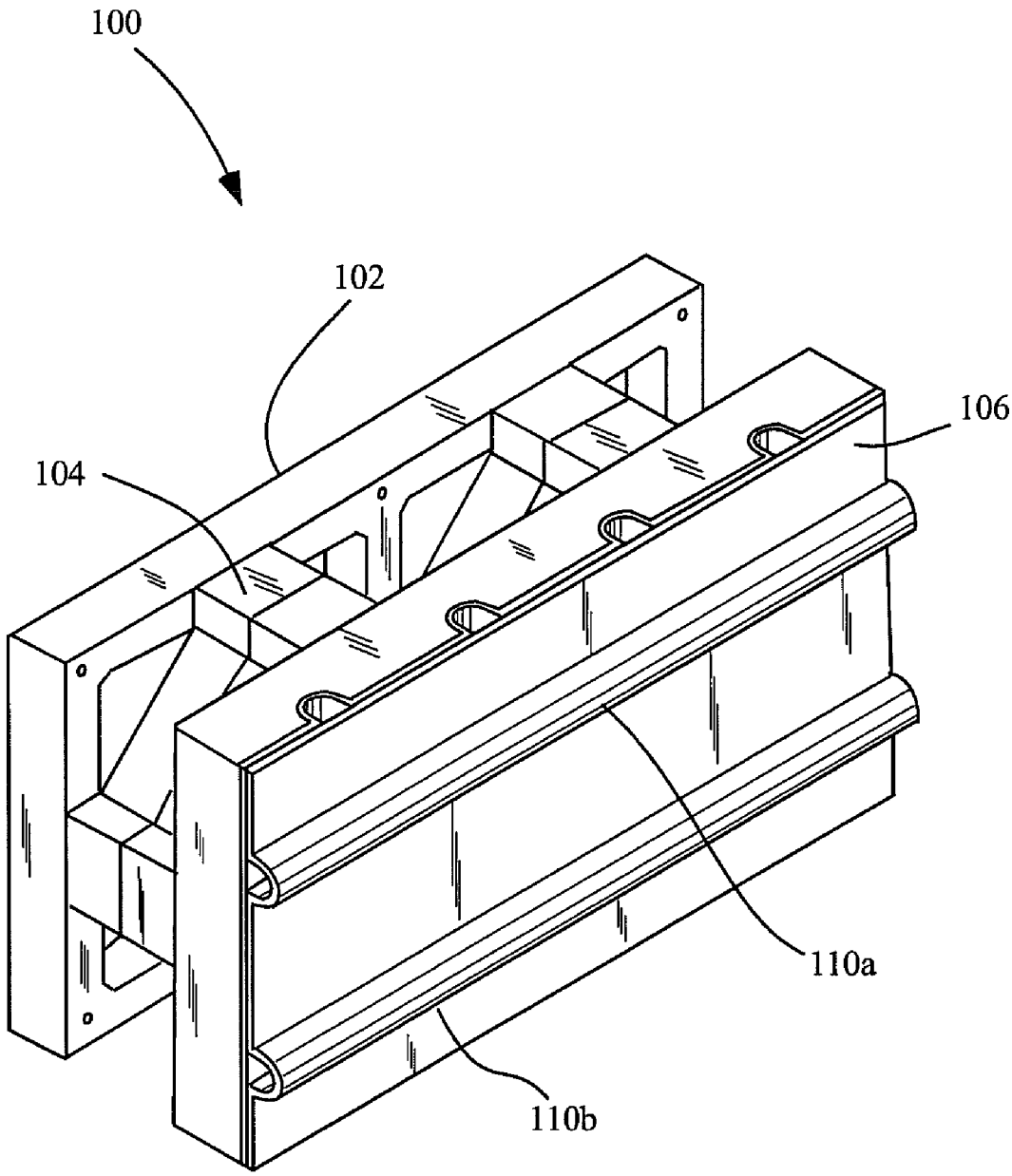

Referring now to FIGS. 1*c* and 1*d*, an insulation component 106 is attached parallel to the reinforcing component 104. The insulation component 106 includes vertical electrical conduits 108*a*, 108*b*, 108*c*, and 108*d* that extend vertically across the insulation component 106. For example, electrical wires, cables, or fibers can be placed in these vertical electrical conduits. Horizontal electrical conduits 110*a* and 110*b* are also provided and extend horizontally and in a different plane from the vertical electrical conduits 108*a*, 108*b*, 108*c*, and 108*d*. In one example, the horizontal electrical conduits 110*a* and 110*b* provide conduits for electrical wires.

The vertical electrical conduits 108*a*, 108*b*, 108*c*, 108*d* and horizontal electrical conduits 110*a* and 110*b* may be in the form of pipes or pipe-like structures that are used to hold any type of electrical component such as wires, wire cables, fiber optic cables, or the like. Alternatively, the vertical electrical conduits 108*a*, 108*b*, 108*c*, 108*d* and horizontal electrical conduits 110*a* and 110*b* may be in the form of a hollow channel having any type of cross section (e.g., circular, elliptical, square, or rectangular).

In an alternate approach, the vertical electrical conduits 108*a*, 108*b*, 108*c*, 108*d* and horizontal electrical conduits 110*a* and 110*b* may be used for plumbing components to provide plumbing functions. In this case, the conduits may be pipes. Other uses for the conduits are possible. Alternatively, providing air-space between panels can be used as an alternative to the building services component to allow for the use of conventional building system approaches.

Figure 1E:
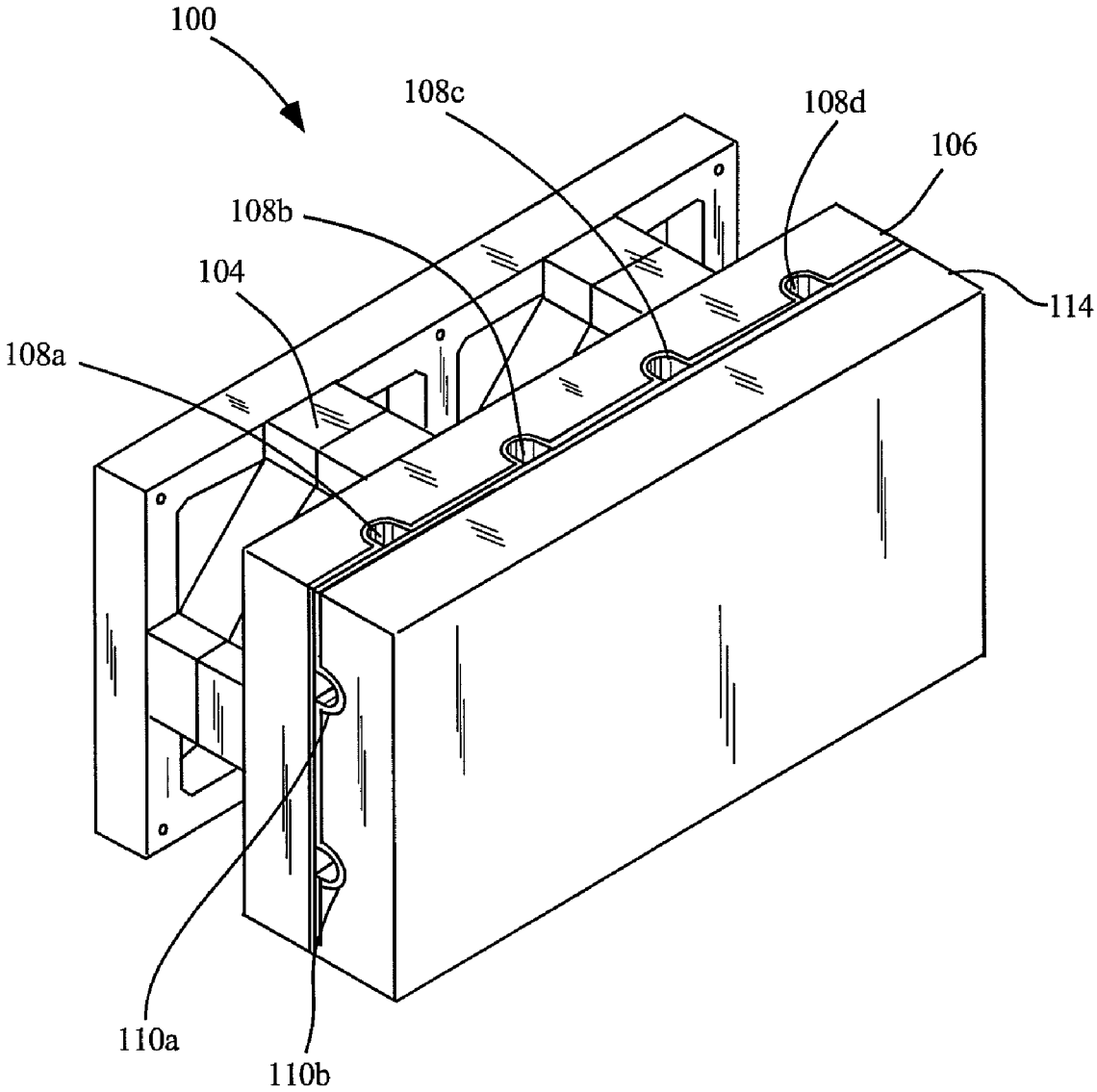

Referring now to FIG. 1*e*, a horizontal conduit component 114 is shown formed around the horizontal electrical conduits 110*a* and 110*b*. The horizontal conduit component 114 surrounds the horizontal electrical conduits 110*a* and 110*b* and may be constructed from cement, plastic, metal, or any combination of these or other materials.

Figure 1F:
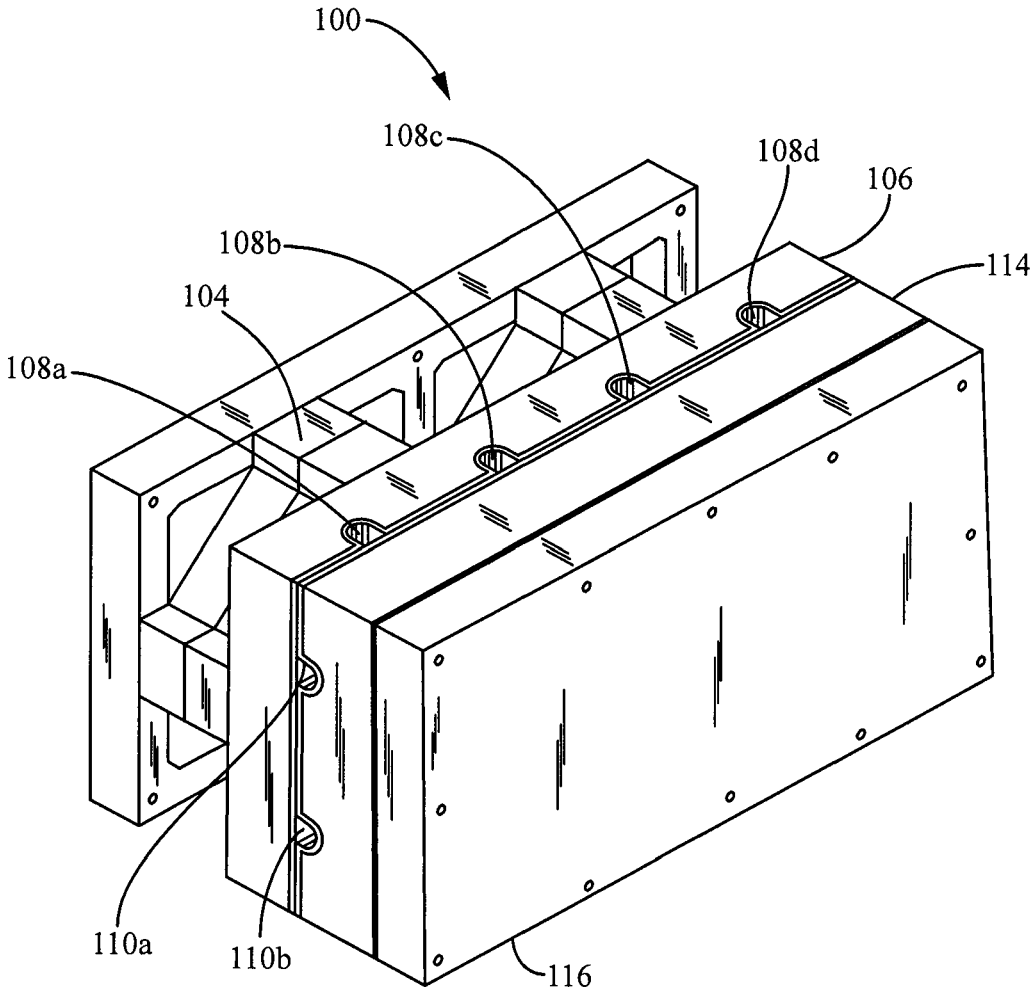

Referring now to FIG. 1*f*, a second side component 116 is coupled parallel to the horizontal conduit component 114. As with the outer component 102, the second side component 116 may be constructed using cement, plastic, metal, or any combination of these or other materials. Any of the components mentioned above may be coupled to the other component using pins, screws, nails, adhesive, or any suitable approach and/or material.

Figures 2A, 2B, 2C, 2D:
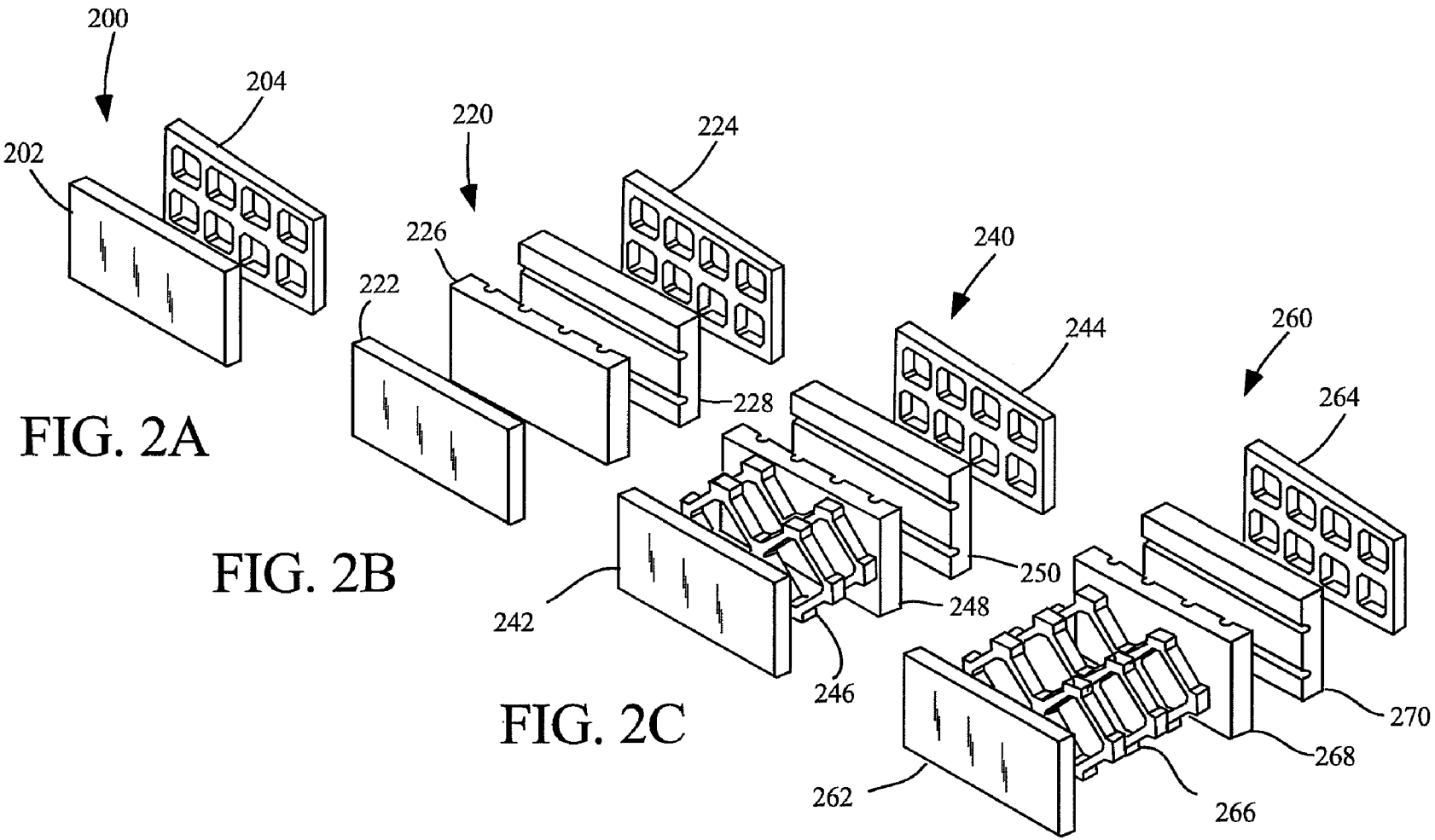
FIGS. 2*a-g* are examples of various types of blocks comprising various components according to the present invention.

Referring now to FIG. 2*a*, another example of a block 200 is described. The block 200 comprises an outside component 202 and an inside component 204 that are coupled together so as to be parallel to each other. The outside component 202 and inside component 204 are coupled together using any suitable coupling arrangement (e.g., coupling pins) (not shown) and may be load bearing and/or non-load bearing components. The outside component 202 and inside component 204 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength of the outside component 202 and inside component 204. The components 202 and/or 204 may be vertical load bearing components, or protective shell components.

Referring now to FIG. 2*b*, another example of a block 220 is described. This block provides a non-load bearing assembly with the integration of external systems (e.g., electrical or plumbing systems). The block 220 comprises an outside component 222 and an inside component 224. In addition, the block 220 comprises a vertical conduit component 226 and a horizontal conduit component 228. The outside component 222, inside component 224, vertical conduit component 226, and horizontal conduit component 228 may be arranged so as to be parallel to each other. Any of the outside component 222, inside component 224, vertical conduit component 226, or horizontal conduit component 228 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide rigidity and compressive strength for the components. The components are coupled together in parallel by pins or any suitable coupling arrangement (not shown). The components 222 and/or 224 may be vertical load bearing components or protective shell components.

Referring now to FIG. 2*c*, another example of a block 240 is described. This block provides a load bearing assembly with the integration of external systems. The block 240 comprises an outside component 242 and an inside component 244. In addition, the block 240 comprises a seismic restraint component 246, a vertical conduit component 248 and a horizontal conduit component 250. The outside component 242, inside component 244, and horizontal conduit component 250 are connected parallel to each other. The seismic restraint component 246 is positioned between the outside component 242 and the vertical conduit component 248. The components 242 and/or 244 may be vertical load bearing components or protective shell components.

The outside component 242, inside component 244, seismic restraint component 246, vertical conduit component 248, and horizontal conduit component 250 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The outside component 242, inside component 244, seismic restraint component 246, vertical conduit component 248, and horizontal conduit component 250 may be coupled together in parallel by pins or any suitable coupling arrangement (not shown).

The seismic restraint component 246 may be constructed using any number of patterns or configurations but in one approach is a truss-like structure as described elsewhere in this specification. In one example, the seismic restraint component 246 may be formed from concrete and reinforced with metal rods, wires, fiber, or roping. The type and diameter of the particular reinforcement used along with the quality and layout of the reinforcement provides the desired strength characteristic. The component 246 provides lateral bracing. When this block is used in conjunction with a vertical loading component, it creates a truss.

Referring now to FIG. 2*d*, another example of a block 260 is described. This block provides for the ability to handle increased structural loads with poured-in place option and auxiliary system integration. The block 260 comprises an outside component 262 and an inside component 264. In addition, the block 260 comprises a seismic restraint component 266, a vertical conduit component 268 and a horizontal conduit component 270. The outside component 262, inside component 264, vertical conduit component 268, and horizontal conduit component 270 are connected parallel to each other. The seismic restraint component 266 is positioned between the outside component 262 and the vertical conduit component 268. The components 262 and/or 264 may be vertical load bearing components and/or protective shell components.

The outside component 262, inside component 264, seismic restraint component 266, vertical conduit component 268, and horizontal conduit component 270 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The outside component 262, inside component 264, seismic restraint component 266, vertical conduit component 268, and horizontal conduit component 270 may be coupled together in parallel by pins or any suitable coupling arrangement (not shown).

The seismic restraint component 266 is larger in size than the seismic restraint component 266 shown in FIG. 2*c* and may be constructed using any number of patterns or configurations but in one approach is a truss-like structure as described elsewhere in this specification. In one example, the seismic restraint component 266 may be formed from concrete and reinforced with metal rods, wires, fiber, or roping. The type and diameter of the particular reinforcements used along with the quality and layout of the reinforcements provides the desired strength characteristic. The component 266 provides lateral bracing. When used in conjunction with a vertical loading component, it creates a truss.

Figure 2E:
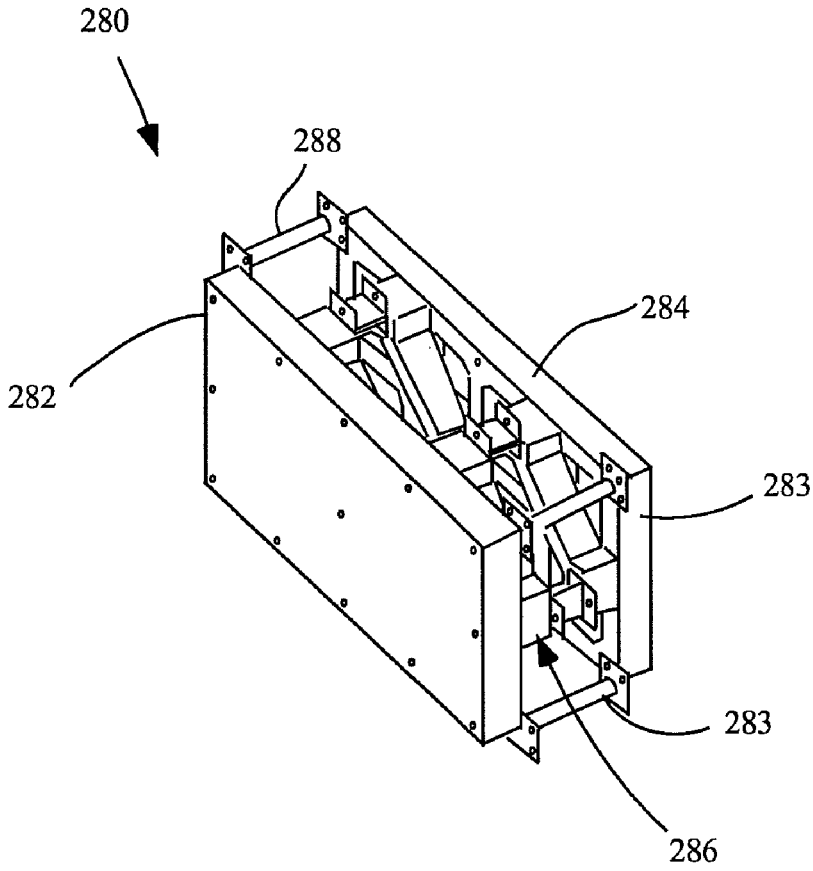

Referring now to FIG. 2*e*, another example of a block 280 is described. The block 280 comprises an outside component 282 and an inside component 284. The outside component 282 and the inside component 284 may be coupled so as to be parallel to each other. In addition, the block 280 comprises a seismic restraint component 286, which is positioned between the outside component 282 and the inside component 284. The components are held together by coupling pins 288.

The outside component 282, inside component 284, seismic restraint component 286 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The components may be coupled together by pins or any suitable coupling arrangement.

The seismic restraint component 286 may be constructed using any number of patterns or configurations but in one approach is a truss-like structure as described elsewhere in this specification. In one example, the seismic restraint component 286 may be formed from concrete and reinforced with metal rods, wires, fiber, or roping. The type and diameter of the particular reinforcement used along with the quality and layout of the reinforcement provides the desired strength characteristic.

Figure 2F:
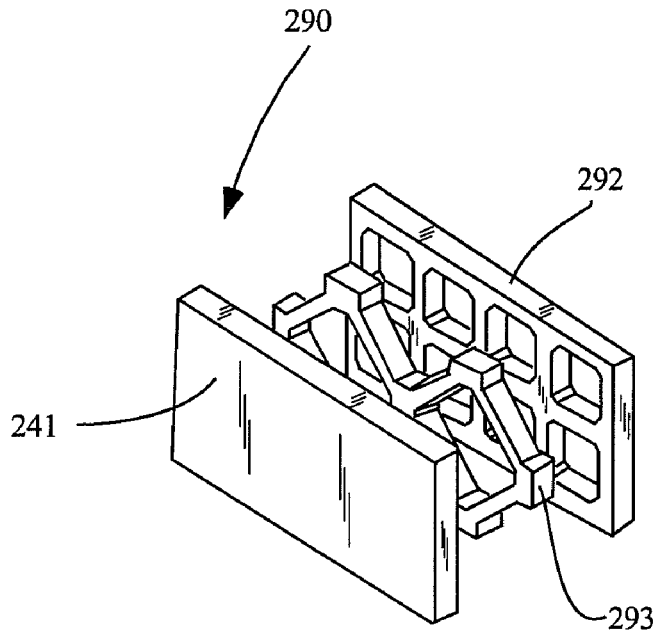

Referring now to FIG. 2*f*, another example of a block 290 is described. This block can be integrated into one panel, but doing so limits the ability to integrate other systems. The block 290 comprises an outside component 291, an inside component 292, and a seismic restraint component 293. As with the other blocks described herein, any of the outside component 291, inside component 292, or seismic relief component 293 can be constructed of any suitable material. The seismic relief component 293 provides lateral bracing. When the block is used in conjunction with vertical load bearing components, it creates a truss. The outside component 291 and inside component 292 provide vertical load bearing functionality and/or protective shell functionally.

Figure 2G:
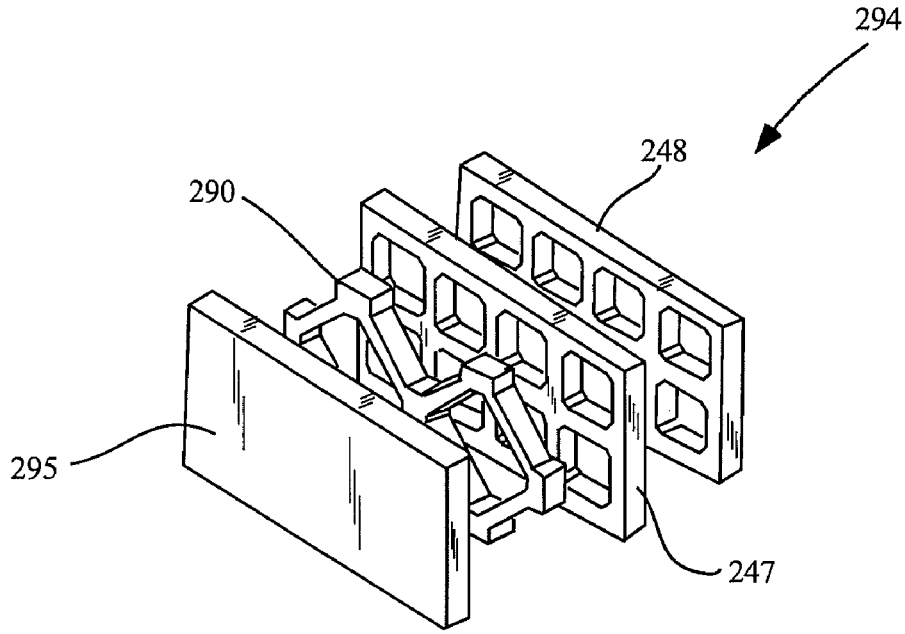
Figure 2I:
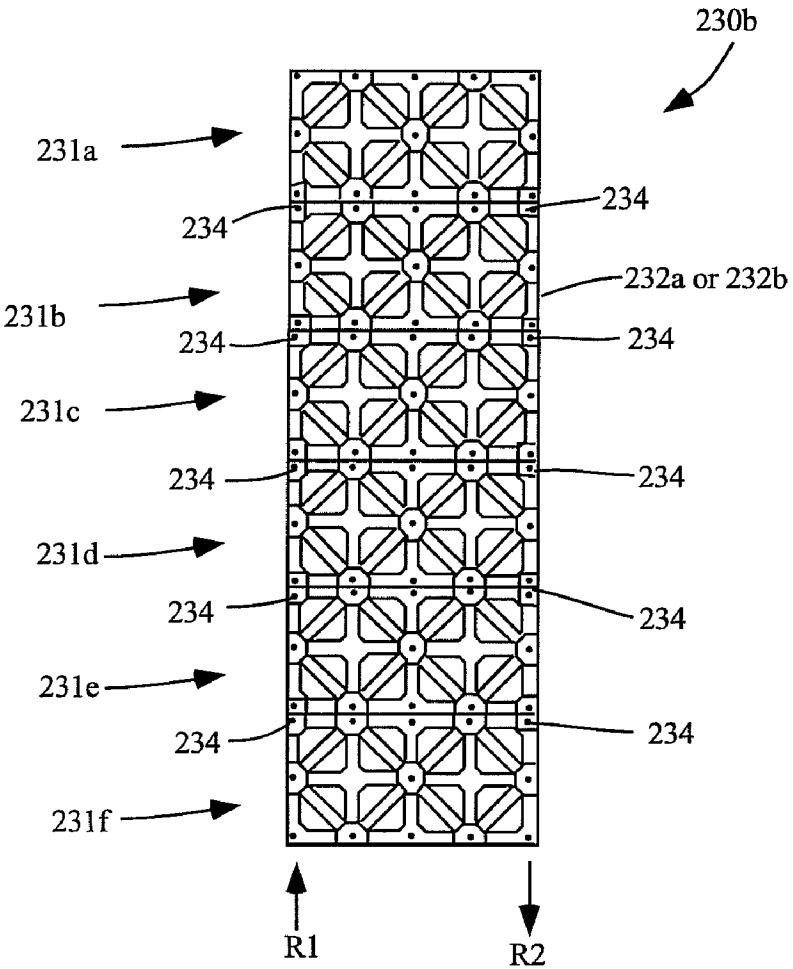
FIGS. 2*h-l* are examples of various structures formed by blocks according to the present invention.
Figure 2H:
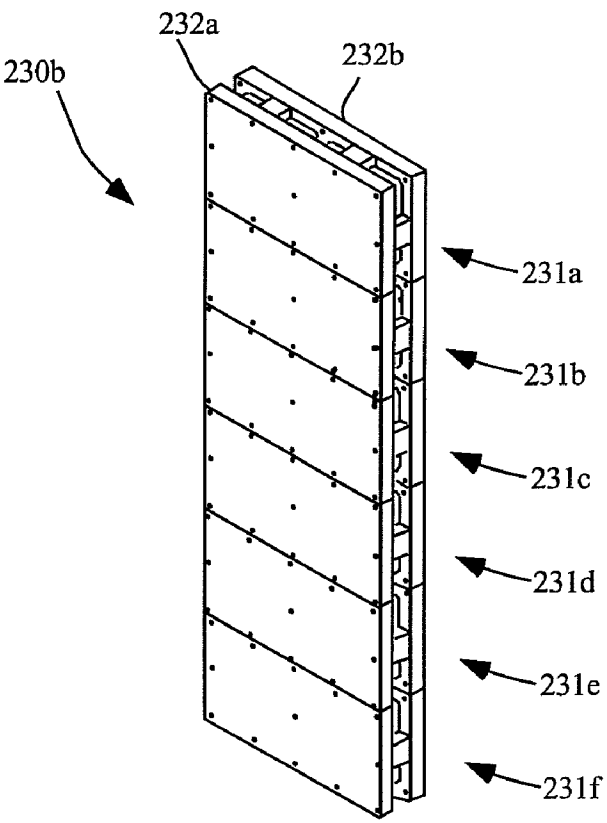

Referring now to FIG. 2*g*, another example of a block 294 is described. This block provides load bearing functions with air/space for integration into conventional systems. For instance, separation of the components with spacers provides space for poured-in-place concrete. The block 294 comprises an outer component 295, an inner component 298, a seismic restraint component 296, and an inner load bearing component 297. As with any of the other blocks described herein, any of the components may be constructed using any suitable material. The seismic relief component 296 provides lateral bracing. When the block is used in conjunction with vertical load components, it creates a truss. The outside component 295, inside component 298, and inner load bearing component 297 provide vertical load bearing function and/or protective shell functionality.

Figure 2J:
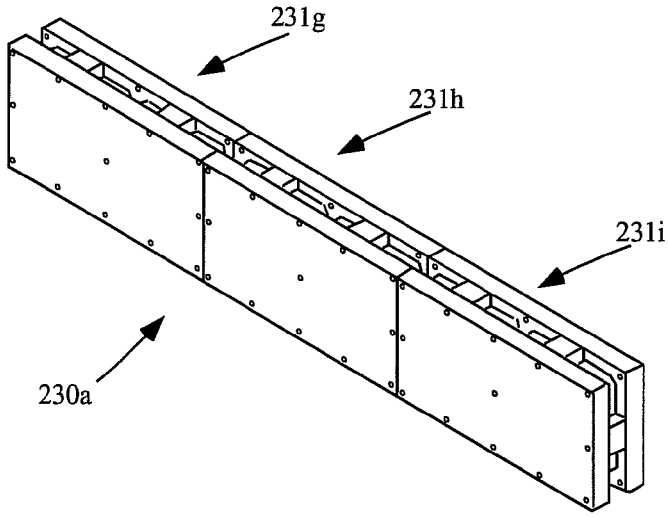
Figure 2K:
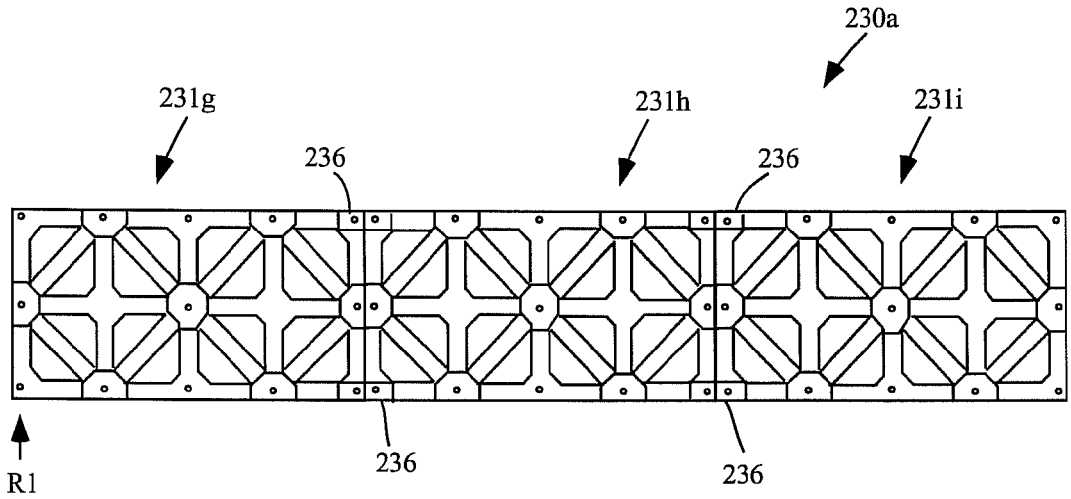
Figure 2L:
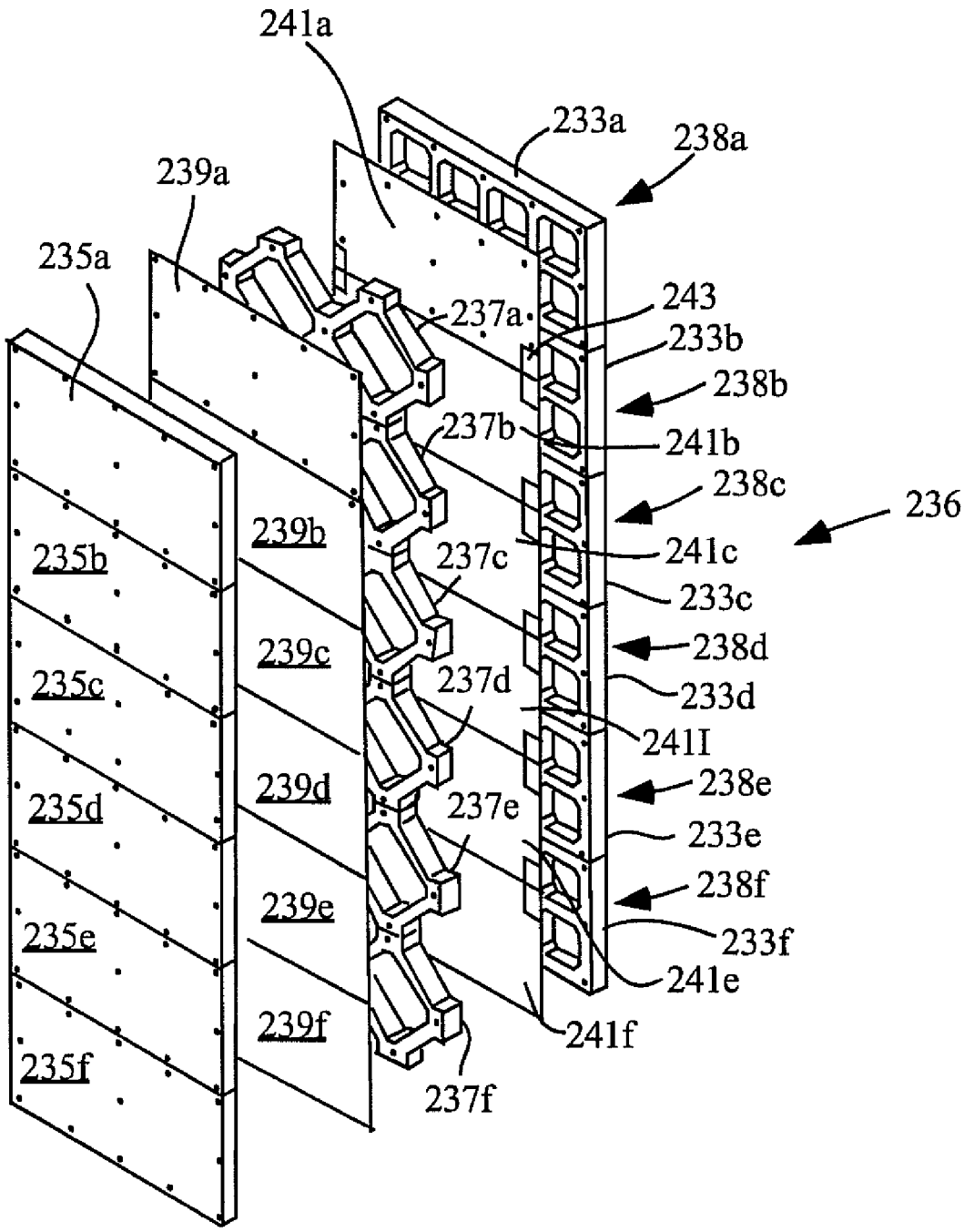

Referring now collectively to FIGS. 2*h*-2*k*, examples of block structures 230*a* and 230*b* that are formed by connecting various types of blocks are described. In one example (FIGS. 2*h-i*), components 232*a* and 232*b* are coupled together to form a block 231*a*. Other components are coupled together to form blocks 231*a*, 231*b*, 231*c*, and 231*f* (FIGS. 2*h-i*) and blocks 231*g*, 231*h*, and 231*i* (FIGS. 2*j-k*). As shown, connector plates 234 are used to secure blocks 231*a*, 231*b*, 231*c*, 231*d*, 231*e*, and 231*f* together (FIGS. 2*h-i*) and thereby form a wall structure. In addition, connector plates 236 are used to connect blocks 231*g*, 231*h*, and 231*i* together (FIGS. 2*j-k*) to form a beam structure. In both cases, a truss structure is formed. The plates 234 and 236 strengthen the resulting structures. As with the other block components described herein, any of the block components can be constructed of any suitable material.

Metal plates can be used to provide addition strength for any of the blocks or structures described herein. Referring now to FIG. 21, a wall structure 236 comprises a plurality of blocks 238*a*, 238*b*, 238*c*, 238*d*, 238*d*, and 238*f*. The blocks respectively each include an inner component 235*a, b, c, d, e*, or *f*, an outer component 233*a, b, c, d, e*, or *f*, a first metal plate 239*a, b, c, d, e*, or *f*, a second metal plate 241*a, b, c, d, e*, or *f*, and a seismic component 237*a, b, c, d, e*, or *f*. Additional components may be substituted for these components. The first metal plates 239*a, b, c, d, e*, or *f* are held together by connector plates (not shown). The second metal plates 241*a, b, c, d, e*, or *f* are held together by connector plates 243. The metal plates 239*a, b, c, d, e*, or *f* and 233*a, b, c, d, e*, or *f* provide addition structural strength and support for the wall structure 236.

Figure 3:
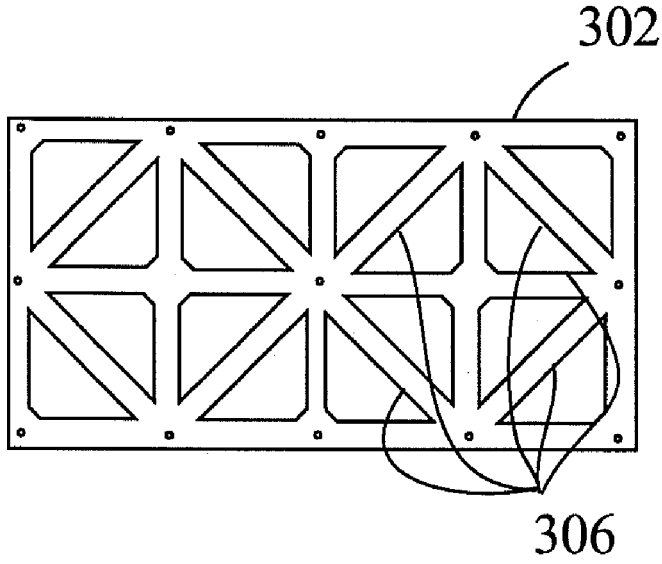
FIG. 3 is an example of a truss structure of a block component according to the present invention.

Referring now to FIG. 3, one example of the internal structure of a component of a block is described. The block component 300 comprises a truss structure that includes a plurality of members arranged in a honeycomb pattern. More specifically, the block component 300 includes horizontal members 302, vertical members 304, and diagonal members 306. It will be appreciated that the members may be aligned in any number of angles, configurations, or patterns besides the pattern shown in FIG. 3.

If vertical load and seismic relief components are used, the vertical load component (i.e., outer and inner panel) and the lateral bracing component (seismic panel) may be assembled together to create a truss. The two components can be fabricated as one panel component. Advantageously, these separate components allow easier incorporation of the building system components.

As shown, the horizontal members 302, vertical members 304, and diagonal members 306 are formed together in one mold so that they form one piece. Alternatively, each of the horizontal members 302, vertical members 304, and diagonal members 306 may be formed separately and attached together with some attachment mechanism (e.g., glue, screws, or pins). In still another, some of the horizontal members 302, vertical members 304, and diagonal members 306 may be formed separately and some formed together.

Each of the horizontal members 302, vertical members 304, and diagonal members 306 may be formed from materials such as such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The horizontal members 302, vertical members 304, and diagonal members 306 may be formed about reinforcing wire, rope, or fiber for increased strength and stability. Pin connectors 308 may be used to connect the component to other components and form a block.

Figure 4:
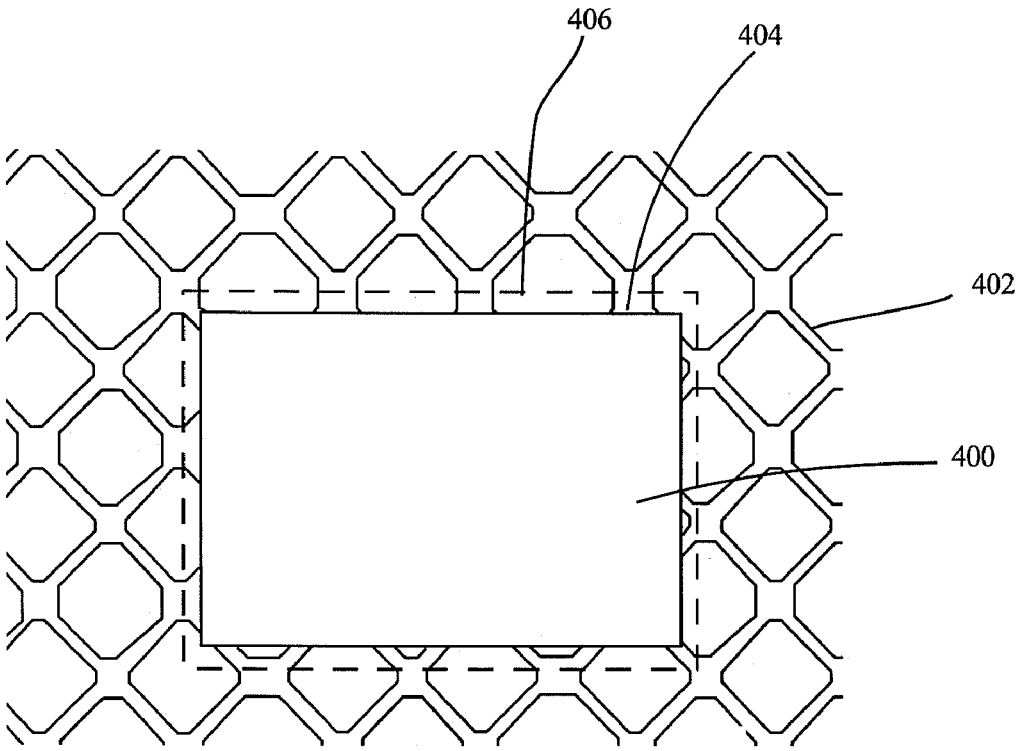
FIG. 4 is an example of a wall assembly having an opening according to the present invention.

Referring now to FIG. 4, one example of providing an opening 400 in a building panel 402 (e.g., a wall) is described. When the individual blocks are assembled together, the wall assembly forms one structural element. Advantageously, this approach allows cut-outs to be made without compromising structural integrity. The opening 400 is provided through the honeycomb truss structure of the building panel 402. The building panel 402 comprises one or more building blocks with each of the blocks having a component with a honeycomb structure. For example, the blocks may include inner and outer components having a solid structure and a seismic restraint component having a honeycomb structure. Alternatively, any of the components may have solid or semi-solid structures.

As shown in FIG. 4, the opening 400 has an edge 404 that is positioned so as to be within a structural integrity boundary 406. If the opening 400 were positioned beyond the structural integrity boundary 406, it is possible that the resulting structure would be unstable. Consequently, because of its positioning, the opening 400 does not detract from the structural integrity of the building panel 402.

Figure 5A:
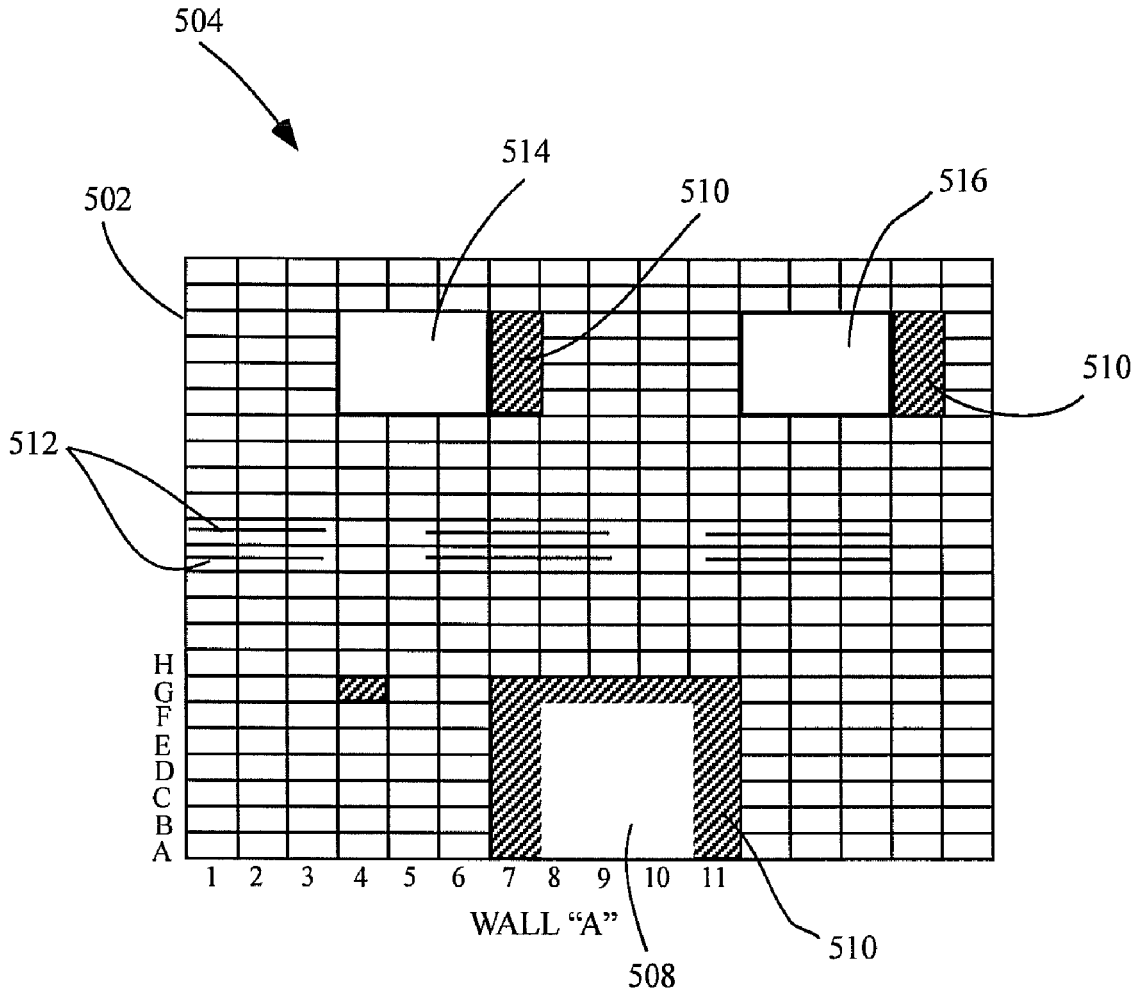
FIGS. 5*a-c* is a diagram of a wall structure comprising a plurality of blocks according to the present invention.

Referring now to FIG. 5*a*, one example of assembling blocks 504 into a building panel 502 (e.g., a wall) of a building is described. The building panel 502 includes a plurality of the blocks 504. Using automated processes and computer software, the block components can be assembled into blocks, labeled for assembly, and palletized for shipment. A builder receives the blocks and uses the labels to assemble the blocks 504 into a wall as shown in FIG. 5*a*.

The labels may utilize any kind of numbering scheme to indicate how a particular block is to be positioned relative to the other blocks to be assembled. For instance, one approach uses a reference system whereby one element represents a row and another element represents a column for placement of each of the blocks 504. In this example, a value of A-1 indicates a particular block should be placed in the first row and first column, and a block labeled C-3 indicates this particular block should be placed in the third row, third column. Other labeling schemes may also be used to facilitate placement and assembly of the blocks.

An opening 508 is configured to be a door. Floor lines 512 occur between the first and second floors of the structure. The blocks between the floor lines 512 may be configured in specific ways to engage or couple to the floor. Openings 514 are 516 are configured to be windows. Highlighted blocks 510 to indicate that the blocks require modification (e.g., painting, sanding, or the addition of other elements). The highlighted areas indicate areas of special attention. This may include custom block fabrication, standard block modification or additional panel components. The openings 508, 514, and 516 are positioned and are of suitable dimensions so as to not detract from the structural integrity of the building panel 502.

Figure 5B:
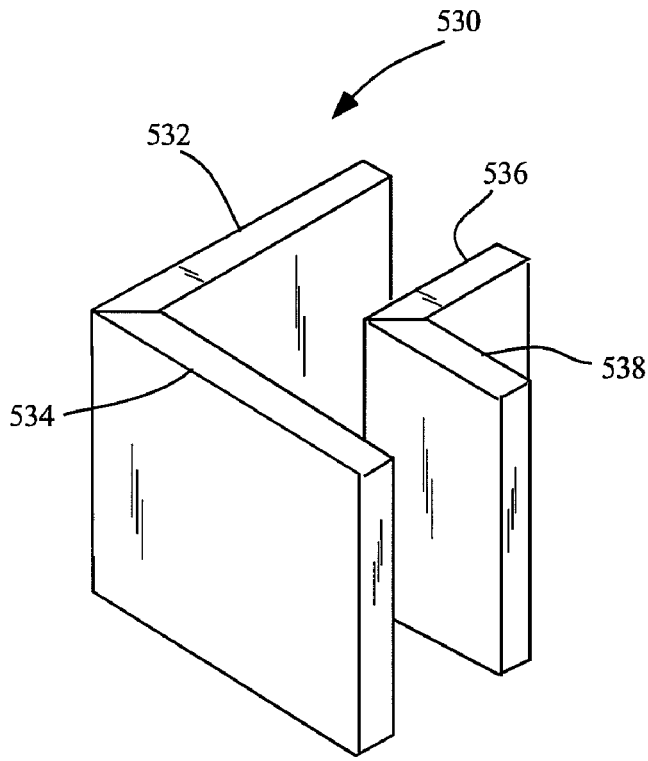
Figure 5C:
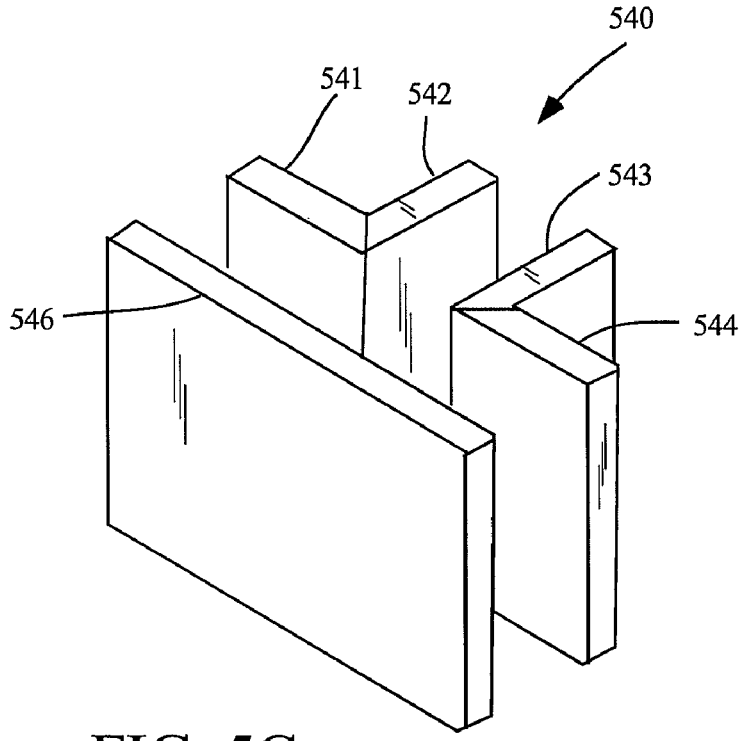

Referring now to FIGS. 5*b*-5*c*, examples of employing the blocks in various wall structures 530 and 540 are described. For example, the wall structure 530 can be created by forming walls 532 and 534 and 536 and 538 respectively. Prefabricated corners and intersections complying with design requirements for wall assemblies can be formed. Similarly, the walls 541, 542 and 543, 544 and 546 can be configured as shown using the blocks described herein. The walls 532, 534, 536, 538, 541, 542, 543, 544, and 546 can be constructed using any of the blocks (with any of the components) described herein.

Figure 6:
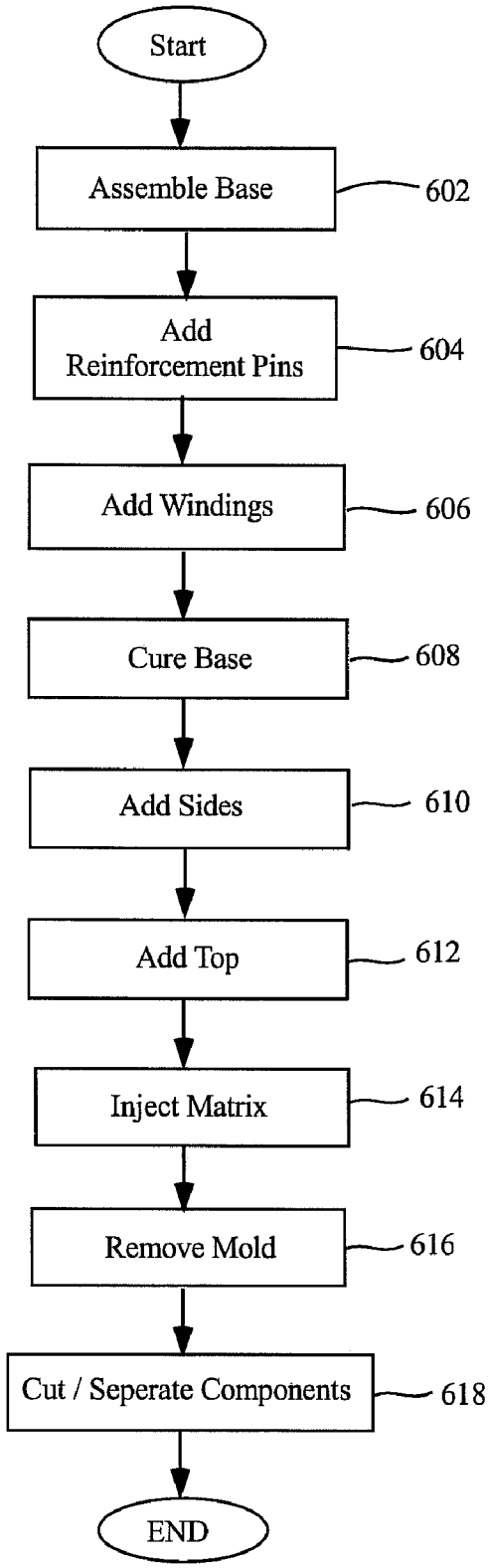
FIG. 6 is a flowchart of the manufacturing steps for a component to be used in a block according to the present invention.

Referring now to FIG. 6, one example of a manufacturing process that is used to construct components of a block is described. At step 602, a base mold is assembled and placed on the belt. Specifically, metal base plates are aligned on a conveyor belt system. The conveyor belt may be angled downward, for example, at a 30 degree angle.

At step 604, reinforcement connector pins are added to the mold. More specifically, these pins are attached to the metal base plates.

At step 606, reinforcement windings are added. Specifically, as the metal base plates move along the conveyor, a continuous reinforcement (e.g., carbon fiber, wire rope, cable) is attached to the reinforcement connection pins. The number and/or size of the reinforcement windings vary depending upon tensile strength requirements of the block. The winding is applied to the mold in a continuous operation.

If a fiber reinforcement is used for the winding, the bonding matrix (e.g., the material applied around the winding in the mold channel to provide the structure of the component) may be thermoset or thermoplastic. In this case, the speed of the conveyor is adjusted to allow the base a sufficient amount of time to cool. The length of the conveyor may be adjusted based upon the length of the cooling. In some preferred approaches, a bonding matrix that is resistant to heat and alkali is used. Heat curing can be used to cure the winding, for example, when the winding is a fiber reinforcement and the material used for the component is resin.

At step 608, preheating of the base plate occurs. At this step, the base plate travels through an oven and the oven heats the mold sections including the base plate. The mold sections may be heated by convective heating, conductive heating, or a combination of both convective and conductive heating. Other techniques such as microwave heating and ultrasound may also be used. Preferably, the heating is evenly applied to the plate so as to maintain dimensional accuracy and prevent warping of the mold. Operating temperatures may be as high as possible without causing the bonding matrix or material to boil prior to setting. For example, the temperature may be 120-300 degrees Fahrenheit.

At step 610, as the preheated base mold moves along the conveyor belt, preheated mold sides are placed onto the base mold. Tapered alignment pins may be used to accurately index the sides. At step 612, a flexible belt is applied and rolls along the top of the mold assembly to act as a mold top. The belt applies pressure on the mold sides and the applied pressure thereby locking the mold assembly into position.

At step 614, a matrix or material is poured or injected into the mold. In one example, cement is selected as the matrix and is dispensed at a matrix dispensing point that is positioned just ahead of the mold top. The dispensing points dispenses the matrix continuously, thereby filling the area of the completed mold assembly. Alternatively, the cement may be pressed into the mold. Advantageously, when cement is used as the bonding matrix, the method of hot mold casting described herein speeds the chemical reaction occurring in the cement causing the cement to set faster than would normally occur.

At step 616, when the cement matrix is sufficiently set for a de-mold time period, the mold top, sides, and base are removed and prepared for reuse. For example, the mold components may be cleaned, sprayed with a mold release, and preheated. At step 618, blocks are cut and palletized for delivery.

Figure 7:
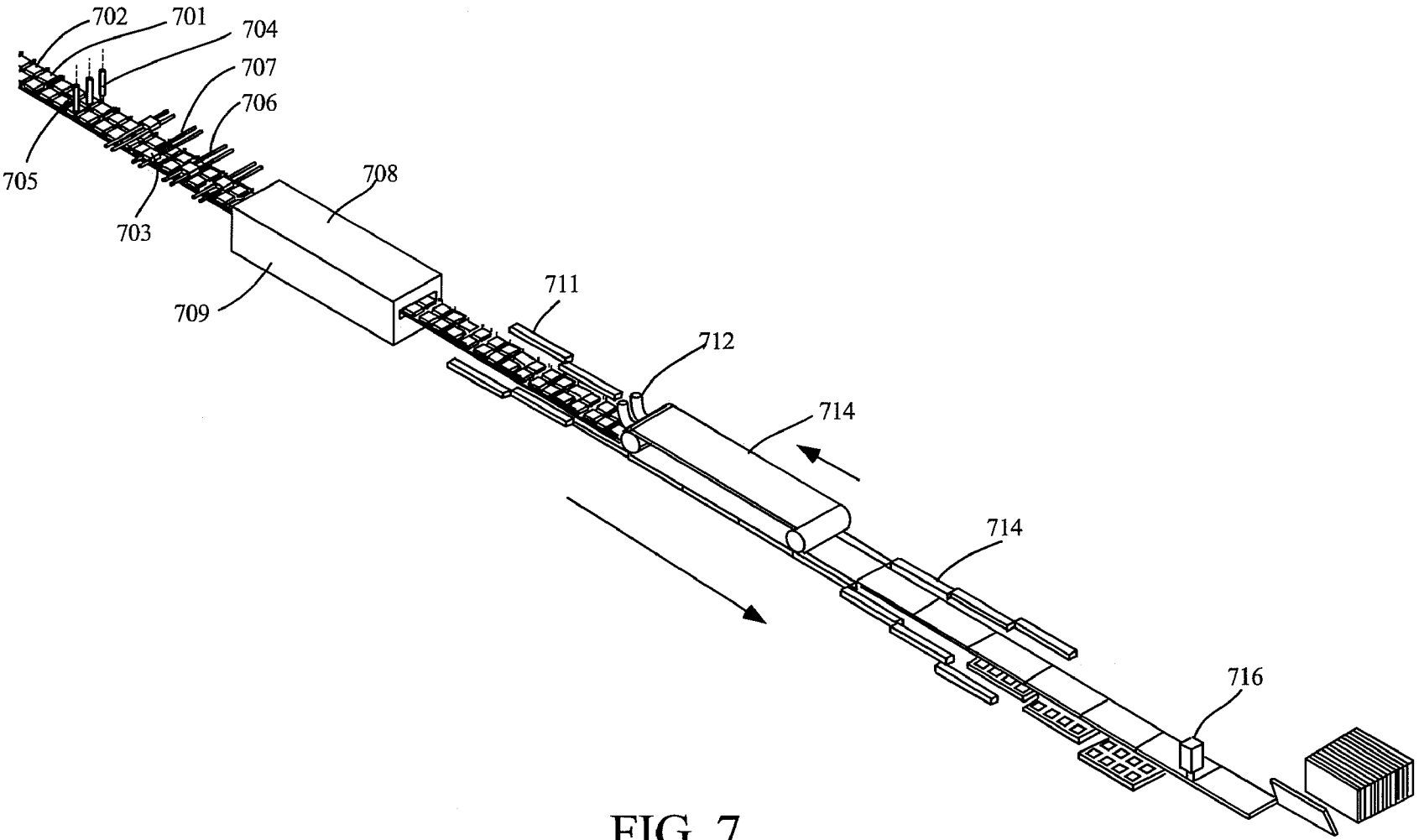
FIG. 7 is a perspective diagram of an assembly line implementing the manufacturing process of FIG. 6 according to the present invention.

Referring now to FIG. 7, an assembly line that is used to implement the method of FIG. 6 is described. In this example, the assembly line 700 is divided into different stations or areas where the various steps are performed. It will be appreciated that the number, type, and functions performed at any of the stations of this example may vary (as can the number and function of stations) according to the specific needs of the manufacturer or end-users.

At station 702, the base mold 701 is assembled and placed on the conveyor belt 703. Step 602 may be performed at the station 702 where metal base plates are aligned on a conveyor belt system. As mentioned, the conveyor belt 703 may be angled downward, for example, at a 30 degree angle.

At station 704, reinforcement connector pins 705 are added (step 604) and at station 706, the continuous reinforcement windings 707 are added (step 606). Specifically, as mentioned, these reinforcement connection pins 705 are attached to the base mold 701 and as the base mold 701 moves along the conveyor belt 703, continuous reinforcement windings 707(e.g., carbon fiber, wire rope) are attached to the reinforcement connection pins 705.

At station 708, heating of the base plate takes place as mentioned at step 608. An oven 709 may be used for this purpose.

At station 710, mold sides 711 are attached (step 610) to the base mold 701. At station 712, cement matrix is poured (steps 612 and 614). At station 714, a mold top (e.g., formed by a surface of a top conveyor belt 721) is applied and the mold sides 711 and base 701 are removed (step 616). The mold sides 711 may be returned to be used by utilizing a path 713 and the base can be returned for reuse via a path 715. At station 716, block components are cut (step 618) and stacked.

Figure 8:
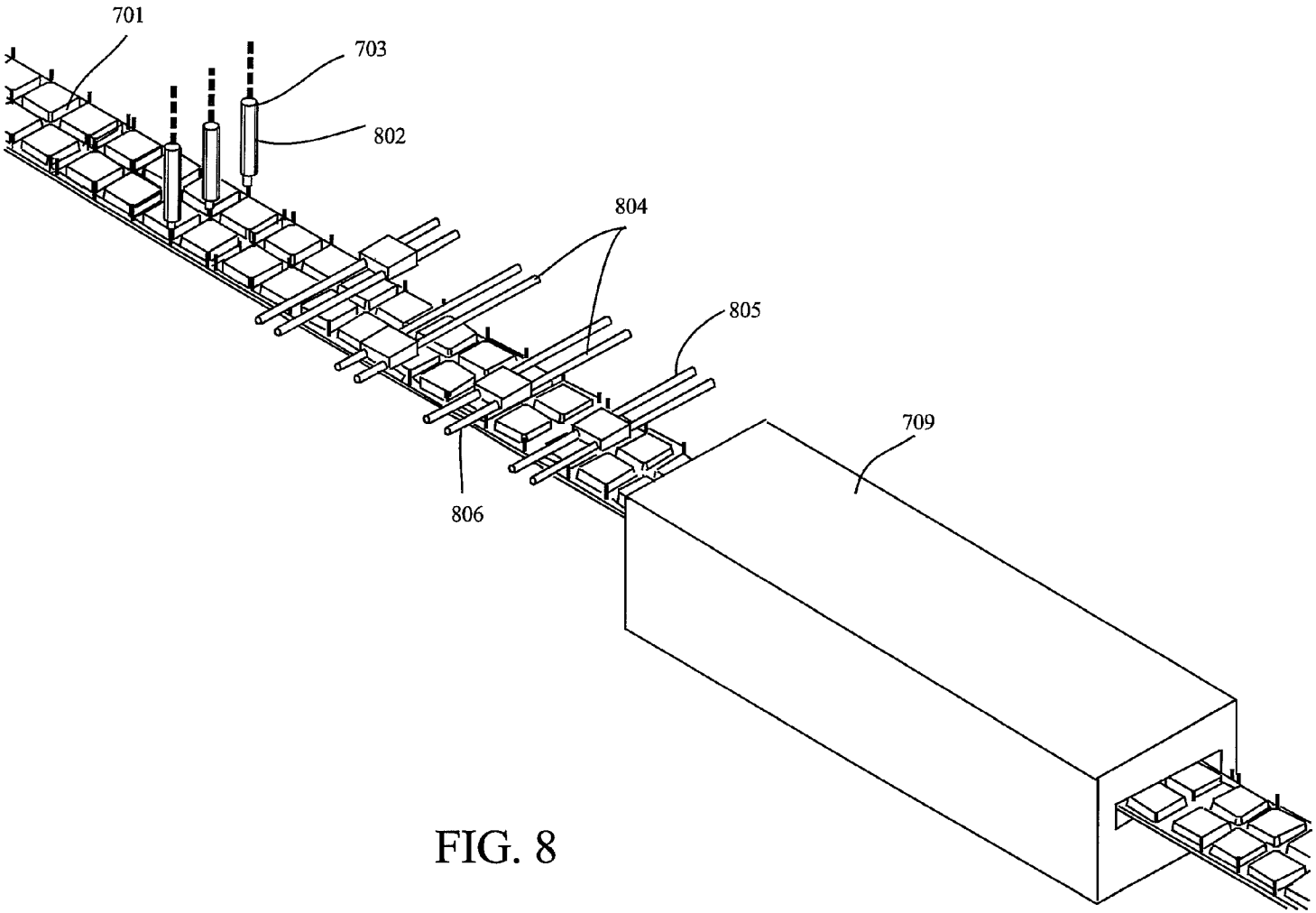
FIG. 8 is a perspective diagram showing details of the portions of the assembly line of FIG. 7 according to the present invention.

Referring now to FIG. 8, one example of how stations 702-708 are used is described. A reinforcement connector pin applicator 802 is used to apply the reinforcement connection pins 705 to the base mold 701 as the base mold 701 moves past the reinforcement connector pin applicator 802. Automated reinforcement machinery 804 is used to attach the continuous reinforcement windings 707 to the mold in the channels 806. Thereafter, the oven 709 is used to heat the base of the base mold 701.

Figure 9:
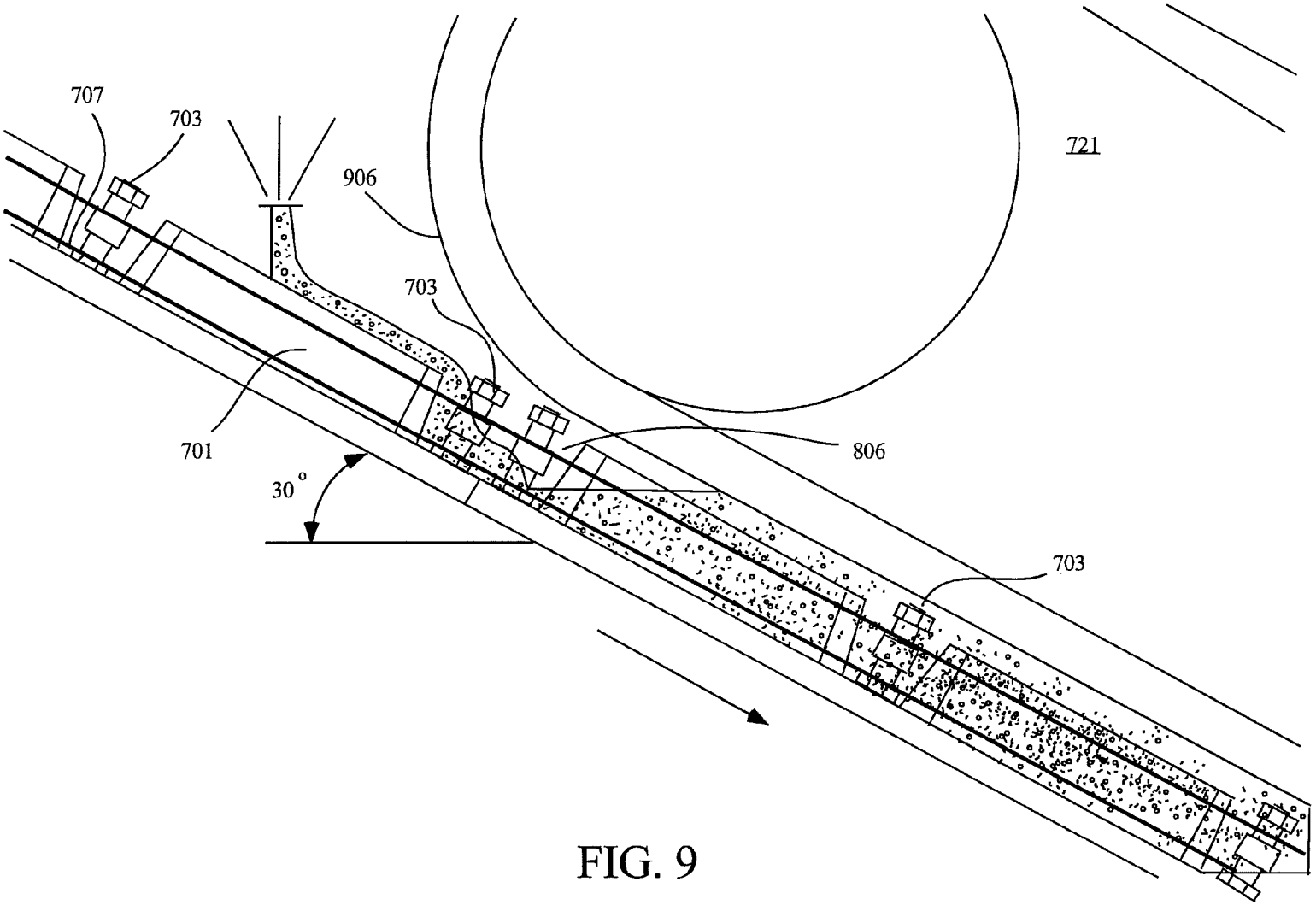
FIG. 9 is a perspective diagram showing other portions of the assembly line of FIG. 7 according to the present invention.

Referring now to FIG. 9, examples of injecting a material or matrix into the base mold 701 on the assembly line are described. A dispenser 900 injects a cement mixture 902 into channels of the base mold 701. The channels 806 include the continuous reinforcement windings 707, which are positioned therein. The mold is positioned on and moves with the conveyor belt 703. The base mold 701 is topped by a surface 906 of the conveyor 721 to hold the cement within the base mold 701. As mentioned, the conveyor belt 703 is positioned at a 30 degree angle to allow the cement or other matrix to flow. The cement is injected into the mold made of the base, the mold sides, and the mold top.

Figure 10A:
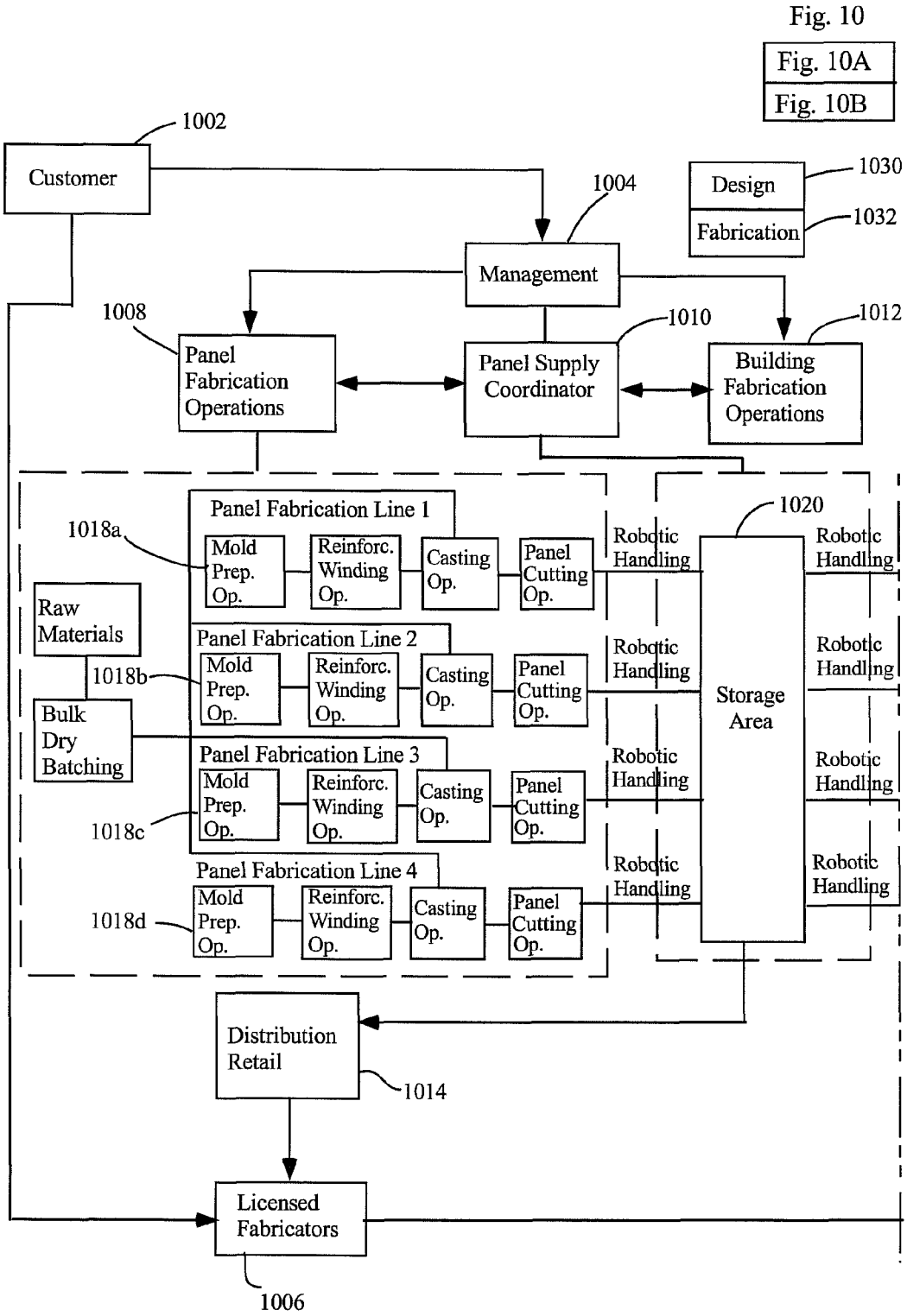
FIG. 10 is a flowchart showing an automated block assembly and distribution process according to the present invention.
Figure 10B:
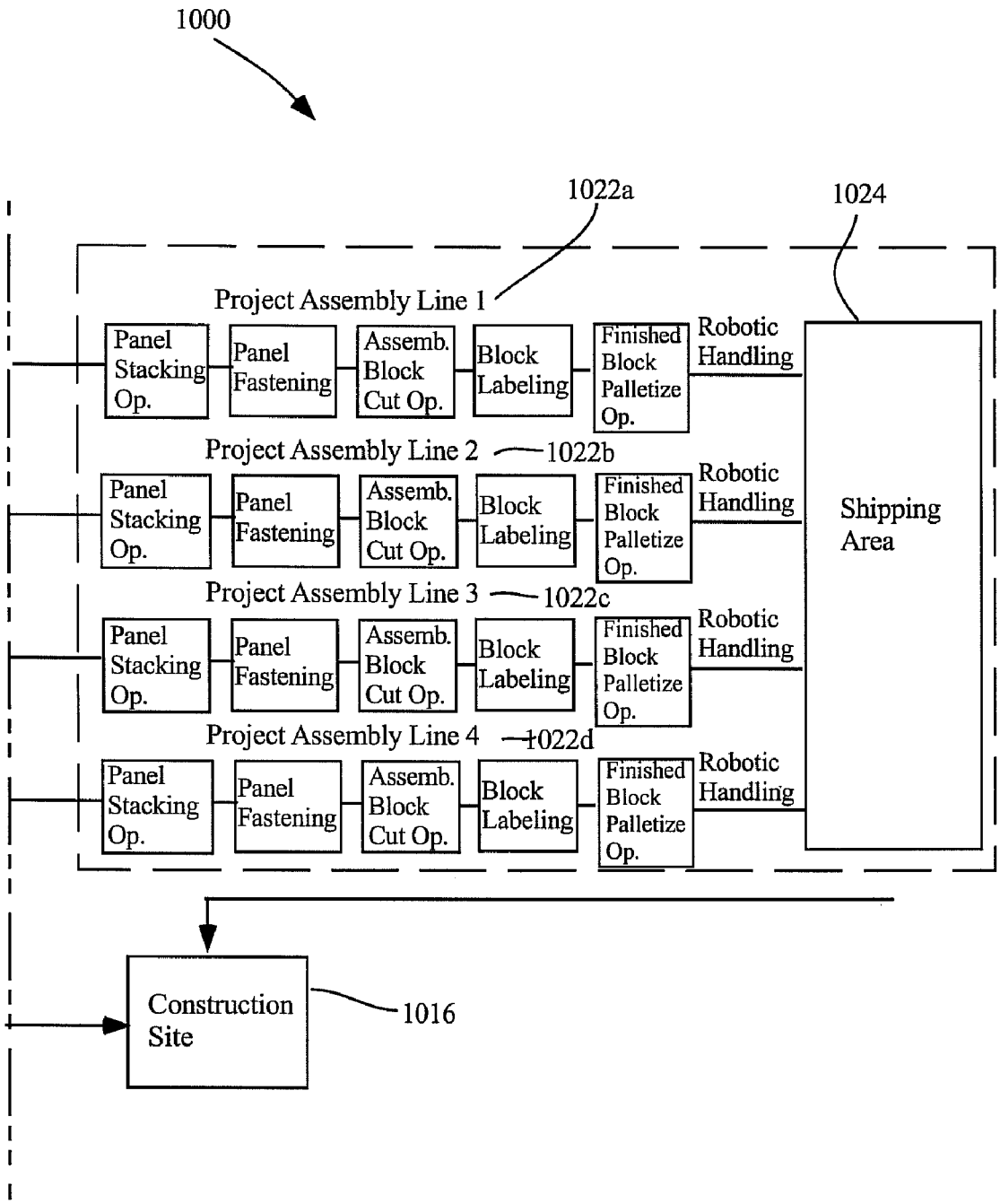

Referring now to FIG. 10, one example of an approach for automated block and building assembly at a factory 1000 is described. A customer 1002 sends instructions or an order to a management module 1004 or a licensed fabricator 1006. In the case of the instructions being sent to the licensed fabricator 1006, a separate, licensed manufacturer assembles the blocks from components made at the factory 1000.

When the customer 1002 requests or it is determined to route the request or order to the factory 1000, the management module 1004 determines whether the order is for a block having customized and un-built components. In this case, the order is routed to a block component fabrication operations module 1008, which constructs the block components for later assembly. Alternatively, the management module 1004 may determine that the block can be constructed from already manufactured components. In this case, the order is routed to a building fabrication operations module 1012, which is used to assemble the components into a block. In another example, the management module 1004 may determine a need to ship components to a distributor 1014 for sale or assembly. In this case, the order is routed to a block component supply coordinator 1010 that facilitates this process.

The computer software used in the system of FIG. 10 can be organized into a design module 1030 and a fabrication module 1032. The design module 1030 and fabrication module 1032 may be located at a central location or may be split apart into sub-modules and executed at different locations within the system. For instance, some sub-modules may be located at or near the assembly line and others of the sub-modules may be located at a central office away from the assembly lines.

More specifically, the design module 1030 can assist an architect or designer during the design and construction document phase of a project. The design module may be a stand-alone module used by a customer. The design module 1030 may assist with wall layouts, evaluate door and window placement, identify problems areas and propose alternatives, generates floor and roof panels, create parts and/or materials lists, perform cost analysis, and generate other details for the plans.

The fabrication module 1032 can be used to take the information created in the design module (e.g., the materials list) and converts the information into data that is used to fabricate the building blocks. The fabrication module 1032 may be integrated with the assembly line process control system to fully automate the block component production. For example, the fabrication module 1032 may determine quantities of each composite component, cut the components into particular shapes, mark the components, assemble the block components to create a wall panel, and palletize the components and prepare the components for shipment. The fabrication module 1032 can evaluate, route, and create machine code.

In one example of the operation of the system of FIG. 10, the customer 1002 sends an order for a particular block to the management module 1004. Alternatively, the order may be intended for or routed to a licensed fabricator 1006. The management module 1004 determines that some or all of the block components need to be manufactured and sends the order to the block component fabrication operations module 1008. The block component fabrication operations module 1008 instructs one of the assembly lines 1018*a*, 1018*b*, 1018*c*, and/or 1018*d* to fabricate the components of the blocks. After construction, the block components may be placed in a storage area 1020. The block component supply coordinator 1010 takes the blocks from the storage area 1020 and sends the components as appropriate to one or more project assembly lines 1022*a*, 1022*b*, 1022*c*, and 1022*d* for assembly into a completed block. The building fabrication operations module 1012 then facilitates the construction of the blocks by controlling the operation of the project assembly lines 1022*a*, 1022*b*, 1022*c*, and 1022*d*. The finished blocks can be sent to a shipping area 1024 and then to a construction site 1016 for assembly into a wall or other building structure.

More specifically, the block component fabrication lines 1018*a-d* are used to construct block components. For example, the lines may have mold preparation, reinforcement, casting, and cutting operations. From there, components are sent to a storage area 1020.

The project assembly lines 1022*a-d* are used to assemble the blocks from the components. These include component stacking, block assembly, labeling, and palletizing the finished block. At the end of these assembly lines 1022*a-d*, a complete block has been assembled. Robotic handling may be used to move the components from the assembly lines 1018*a-d* to the storage area 1020, from the storage area 1020 to the assembly lines 1022*a-d*, and from the assembly lines 1022*a-d* to the shipping area 1024.

Components in the storage area 1020 may be sent to retail or distributor 1014. From the retail/distributor 1014, the components may be sent to a licensed fabricator 1006 for assembly into blocks.

Thus, building blocks are provided that have a high degree of design and structural flexibility and have uses that are not limited to specific architectural designs or floor plans. Material, labor, and construction costs are reduced in manufacturing and assembling the blocks. The present approaches also allow for structural openings (e.g., windows and doors) to be placed almost anywhere in structures formed from the blocks while maintaining structural integrity. The building blocks can be fabricated using automated processes and entire buildings can be prefabricated as building blocks, precut, marked, and palletized for shipping. Consequently, constructing a building is greatly simplified and costs are significantly reduced. Various types of computer software or computer processes may also be used for the design, fabrication, delivery, and construction processes.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. A modular prefabricated building block for use in a building panel comprising:

a first load bearing component having a first length, a first width, and a first thickness, the first load bearing component adapted to provide load bearing strength when the modular building block is used to form a rigid structure;

a second load bearing component having a second length, a second width, and a second thickness, the second load bearing component being adapted to provide load bearing strength when the modular building block is used in the rigid structure;

a building services component having a third length, a third width, and a third thickness, the building services component being formed separately from the first load bearing component and the second load bearing component and being positioned between the first load bearing component and the second load bearing component, the building services component comprising a conduit and a surrounding structure, the conduit embedded at least partially within the surrounding structure and providing at least one building service, wherein the building services component is connected to the first load bearing component and the second load bearing component via a first coupling arrangement without using a connector that extends through the building services component;

wherein the first width and the second width are substantially the same as the third width and wherein the first length and the second length are substantially the same as the third length such that the first load bearing component, the second load bearing component, and the building services component when assembled form a block-shaped structure that includes an upper surface and a lower surface;

wherein the upper surface is configured to be attachable to a first other modular building block and the lower surface is configured to be attachable to a second other modular building block, the modular building block, the first other building block, and the second other modular building block together with the others to form the rigid structure;

such that the modular building block, the first other modular building block, and the second other modular building block provide sufficient tensile strength and compressive strength to the rigid structure that is effective to maintain the stability and structural integrity of the rigid structure and prevent the collapse of the rigid structure without the use of any further reinforcing material;

wherein the first load bearing component, the second load bearing component, and the building services component are adapted to be configurable in a plurality of positions relative to the others;

and wherein the modular building block, the first other modular building block, and the second other modular building block are adapted to be arranged in a predetermined pattern.

2. The modular building block of claim 1 wherein the first coupling arrangement comprises at least one coupling pin.

3. The modular building block of claim 1 wherein the building services component comprises a seismic restraint component, the seismic restraint component being coupled to the first load bearing component and the second load bearing component via a second coupling arrangement, the seismic restraint component adapted to provide flexibility for the modular building block.

4. The modular building block of claim 3 wherein the second coupling arrangement comprises at least one coupling pin.

5. The modular building block of claim 1 wherein each of the first load bearing component and the second load bearing component comprise a plurality of trusses.

6. The modular building block of claim 1 further comprising a vapor barrier component.

7. The modular building block of claim 1 wherein the building services component provides plumbing elements.

8. The modular building block of claim 7 wherein the building services component provides electrical connections.

9. The modular building block of claim 1 further comprising an insulation component.

10. The modular building block of claim 1 within the building services component is replaced with an air/space component.

* * * * *